US010098517B2

(12) United States Patent
Suda et al.

(10) Patent No.: US 10,098,517 B2
(45) Date of Patent: Oct. 16, 2018

(54) CLEANING TOOL

(71) Applicant: UNI-CHARM CORPORATION, Ehime (JP)

(72) Inventors: Tomokazu Suda, Kanonji (JP); Satoshi Hasegawa, Kanonji (JP); Akane Matsuyo, Kanonji (JP)

(73) Assignee: UNICHARM CORPORATION, Ehime (JP)

( * ) Notice: Subject to any disclaimer, the term of this patent is extended or adjusted under 35 U.S.C. 154(b) by 417 days.

(21) Appl. No.: 14/766,443

(22) PCT Filed: Jan. 24, 2014

(86) PCT No.: PCT/JP2014/051588
§ 371 (c)(1),
(2) Date: Aug. 6, 2015

(87) PCT Pub. No.: WO2014/123013
PCT Pub. Date: Aug. 14, 2014

(65) Prior Publication Data

US 2015/0366429 A1 Dec. 24, 2015

(30) Foreign Application Priority Data

Feb. 7, 2013 (JP) ..... 2013-022747

(51) Int. Cl.
*A47L 13/16* (2006.01)
*A47L 13/20* (2006.01)
(Continued)

(52) U.S. Cl.
CPC ..... *A47L 13/46* (2013.01); *A47L 13/16* (2013.01); *A47L 13/20* (2013.01); *A47L 13/24* (2013.01); *A47L 13/38* (2013.01)

(58) Field of Classification Search
CPC ..... A47L 13/10; A47L 13/16; A47L 13/20; A47L 13/24; A47L 13/25; A47L 13/252;
(Continued)

(56) References Cited

U.S. PATENT DOCUMENTS 1,637,595 A * 8/1927 Sturgis ..... A47L 13/252 15/147.2
2008/0216269 A1 9/2008 Tsutanaga et al.
(Continued)

FOREIGN PATENT DOCUMENTS

JP 2006-296712 * 11/2006
JP 2011-41828 A 3/2011
(Continued)

OTHER PUBLICATIONS

Office Action in JP Application No. 2013-022747, dated Feb. 7, 2017.
(Continued)

*Primary Examiner* — Mark Spisich
(74) *Attorney, Agent, or Firm* — Hauptman Ham, LLP

(57) ABSTRACT

To provide a cleaning tool with which a cleaning sheet can be efficiently used during cleaning. The present invention relates to a cleaning tool comprising a holding tool for holding a cleaning sheet. In a state in which holding parts of the holding tool are inserted into insertion parts of the cleaning sheet, tension imparting parts of the holding parts impart tensile force on second regions of the cleaning sheet to form tension portions, and sheet members in the tension portions in a length-intersecting direction are moved in directions in which first regions are disposed.

14 Claims, 22 Drawing Sheets

(51) Int. Cl.

| | |
|---|---|
| ***A47L 13/24*** | (2006.01) |
| ***A47L 13/38*** | (2006.01) |
| ***A47L 13/46*** | (2006.01) |

(58) Field of Classification Search

CPC .... A47L 13/254; A47L 13/255; A47L 13/256; A47L 13/38

USPC ..... 15/147.1, 147.2, 223, 226, 229.3, 229.4, 15/229.7, 229.8

See application file for complete search history.

(56) References Cited

U.S. PATENT DOCUMENTS

| | | | |
|---|---|---|---|
| 2009/0307860 | A1 | 12/2009 | Tsuchiya et al. |
| 2011/0099764 | A1 | 5/2011 | Policicchio et al. |

FOREIGN PATENT DOCUMENTS

| | | | |
|---|---|---|---|
| JP | 2011-156295 | * | 8/2011 |
| JP | 4869984 B2 | | 2/2012 |

OTHER PUBLICATIONS

Extended European Search Report in EP Application No. 14749380.3, dated Aug. 4, 2016.

Office Action in CN Application No. 201480007831.X, dated Jun. 1, 2016.

Written Opinion in International Patent Application No. PCT/JP2014/051588, dated Apr. 28, 2014.

International Search Report dated Apr. 28, 2014, corresponding to International application No. PCT/JP2014/051588.

Office Action in TW Application No. 103104111, dated Aug. 8, 2017. 10pp.

* cited by examiner

CLEANING TOOL

RELATED APPLICATIONS

The present application is a National Phase of International Application Number PCT/JP2014/051588, filed Jan. 24, 2014, and claims priority of Japanese Patent Application No. 2013-022747 filed on Feb. 7, 2013.

TECHNICAL FIELD

The present invention relates to a cleaning tool for cleaning an object to be cleaned. Further, internal applications of PCT/JP2014/050380 and PCT/JP2013/079088 are respectively incorporated by reference.

BACKGROUND ART

Japanese Unexamined Patent Application Publication (JP-A) No. 2011-041828 discloses a cleaning tool having a sheet-type cleaning element and a cleaning element holder for holding the cleaning element. The cleaning element is formed by laminating a plurality of sheets and a fiber assembly. The cleaning element holder has a bifurcated shape having a pair of holding plates. The holding plates are elongate flat plates arranged on the same plane. The cleaning element is held by the cleaning element holder when the holding plates are inserted into the holding space of the cleaning element.

PRIOR ART DOCUMENT

Patent Document

Patent Document 1: JP-A No. 2011-041828

SUMMARY OF THE INVENTION

Problem to be Solved by the Invention

In the cleaning tool disclosed in JP-A No. 2011-041828, the holding plates of the cleaning element holder have a plate-like shape and are arranged on the same plane, so that the sheet-like cleaning element is held as it is in the sheet-like form by the cleaning element holder. Although the cleaning element has a fiber assembly, a sweeping-out function of the fiber assembly cannot be efficiently utilized as long as the cleaning element is held as it is in the sheet-like (planar) form during cleaning. Accordingly, it is an object of the present invention to provide a cleaning tool in which a cleaning sheet can be efficiently utilized during cleaning.

Means for Solving the Problem

In order to solve the above-described problem, according to a preferred aspect of the present invention, a cleaning tool having a cleaning sheet and a holder for holding the cleaning sheet is provided. The cleaning tool has a longitudinal direction in which the holder is inserted into the cleaning sheet and a transverse direction crossing the longitudinal direction. The cleaning sheet has a first region formed by a sheet member, a second region formed by a sheet member, and an insertion part which has an insertion space continuously extending in the longitudinal direction in order to allow the holder to be inserted between the first region and the second region. The holder has a holding part which is inserted into the insertion space of the cleaning sheet and holds the cleaning sheet, a tension applying part which is provided in the holding part and applies prescribed tension to the second region of the cleaning sheet, and a grip part which is connected to the holding part and designed to be held by a user. When the holding part of the holder is inserted into the insertion part of the cleaning sheet, the tension applying part of the holding part applies tension to the second region of the cleaning sheet so that the second region forms a tension part, and the sheet member extending in the transverse direction in the tension part is moved in a direction toward the first region.

In a further aspect of the cleaning tool according to the present invention, the tension applying part includes a first tension applying part which applies tension to the first region of the cleaning sheet and a second tension applying part which applies tension to the second region of the cleaning sheet.

In a further aspect of the cleaning tool according to the present invention, the second tension applying part is disposed inward of the first tension applying part in the transverse direction.

In a further aspect of the cleaning tool according to the present invention, the tension part is formed from the second tension applying part to the first tension applying part.

In a further aspect of the cleaning tool according to the present invention, the cleaning sheet is configured to have a high-rigidity region having high rigidity and a low-rigidity region having lower rigidity than the high-rigidity region.

In a further aspect of the cleaning tool according to the present invention, the high-rigidity region continuously extends in the transverse direction In a further aspect of the cleaning tool according to the present invention, the cleaning tool has a first bonded part for connecting the first region and the second region, and the first bonded part is contiguous to the high-rigidity region.

In a further aspect of the cleaning tool according to the present invention, the high-rigidity region is a second bonded part formed by welding the sheet member.

In a further aspect of the cleaning tool according to the present invention, the cleaning sheet has a fiber assembly and the second bonded part connects part of the fiber assembly and the sheet member.

In a further aspect of the cleaning tool according to the present invention, the cleaning tool has an inserting direction parallel to the longitudinal direction and a pulling-out direction opposite to the inserting direction, and a projection formed on a lateral side surface of the extending part. The projection includes an inserting side region on a front side in the inserting direction, a pulling-out side region on a front side in the pulling-out direction, and an intermediate region between the inserting side region and the pulling-out side region. Further, the projection has an insertion starting point at which the inserting side region first gets into contact with the bonded part when the holder is inserted into the insertion part, an insertion end point at which the contact of the inserting side region with the bonded part terminates when the holder is inserted into the insertion part, a first virtual line connecting the insertion starting point and the insertion end point, a second virtual line parallel to the inserting direction and passing through the insertion starting point, a first angle made by the first virtual line and the second virtual line; a pulling-out starting point at which the pulling-out side region first gets into contact with the bonded part when the holder is pulled out of the insertion part, a pulling-out end point at which the contact of the pulling-out side region with the bonded part terminates when the holder is pulled out of the insertion part, a third virtual line connecting the pulling-out starting point and the pulling-out end point, a fourth virtual line parallel to the pulling-out direction and passing through the pulling-out starting point, and a second angle made by the third virtual line and the fourth virtual line. Further, the first angle is smaller than the second angle.

Effect of the Invention

According to the present invention, a cleaning tool in which a cleaning sheet can be efficiently utilized during cleaning can be provided.

BEST MODES FOR CARRYING OUT THE INVENTION (Outline of Cleaning Tool)

A first embodiment of the present invention is now described with reference to FIGS. 1 to 9. A structure of a cleaning tool 100 as one embodiment of a "cleaning tool" according to the present invention is now explained. Objects to be cleaned by using the cleaning tool 100 typically include surfaces to be cleaned (floors, walls, windows, ceilings, external walls, furniture, clothes, curtains, bedding, lighting, home electric appliances, etc.) inside and outside of houses, apartments, buildings, factories, vehicles, etc. and surfaces of human body parts to be cleaned. The surfaces to be cleaned may be either flat or curved, uneven or stepped.

Figure 1:
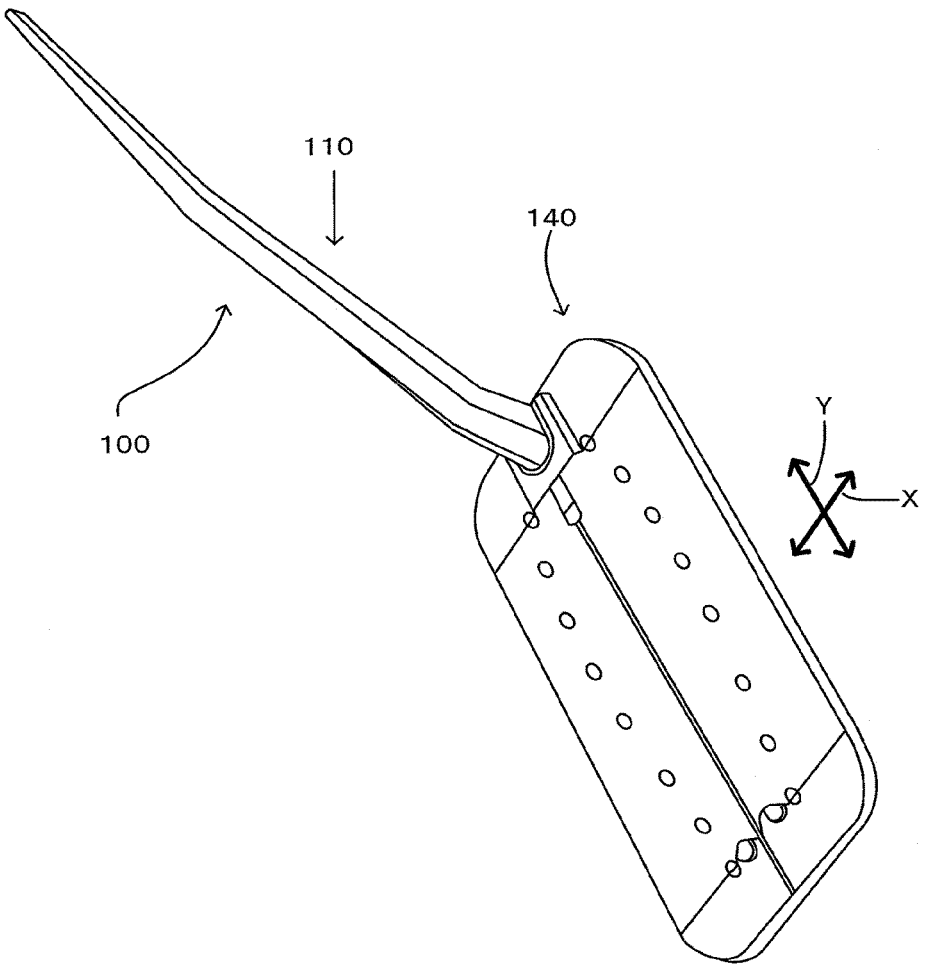
FIG. 1 is a perspective view showing an overall structure of a cleaning tool according to an embodiment of the present invention.

As shown in FIG. 1, the cleaning tool 100 includes a cleaning element holder 110 and a cleaning element 140. The cleaning element holder 110 is configured to be removably attached to the cleaning element 140 and to hold the cleaning element 140. The cleaning tool 100, the cleaning element holder 110 and the cleaning element 140 are example embodiments that correspond to the "cleaning tool", the "holder" and the "cleaning sheet", respectively, according to this invention.

The cleaning tool 100 has a longitudinal direction Y and a transverse direction X crossing the longitudinal direction Y. The longitudinal direction Y is parallel to an inserting direction Y1 in which the cleaning element holder 110 is attached to the cleaning element 140 and to a pulling-out direction Y2 in which the cleaning element holder 110 is pulled out of the cleaning element 140. The longitudinal direction Y, the transverse direction X, the inserting direction Y1 and the pulling-out direction Y2 are example embodiments that correspond to the "longitudinal direction", the "transverse direction", the "inserting direction" and the "pulling-out direction", respectively, according to this invention.

(Structure of the Cleaning Element Holder)

Figure 2:
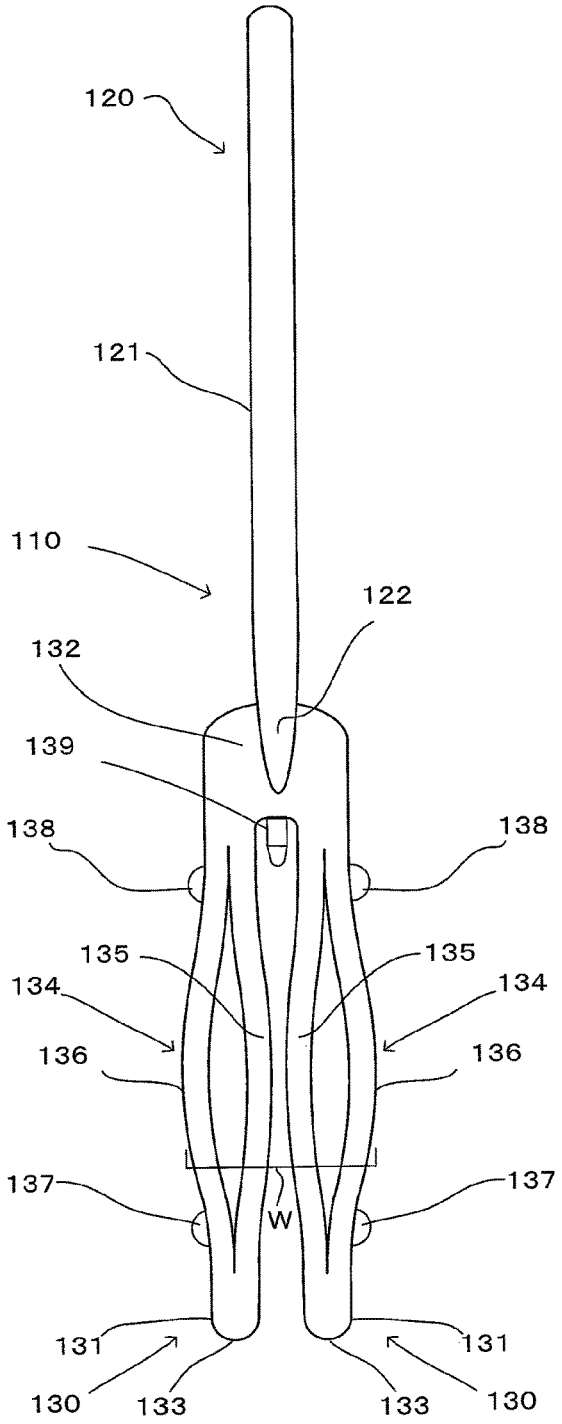
FIG. 2 is a plan view of a cleaning element holder.
Figure 3:
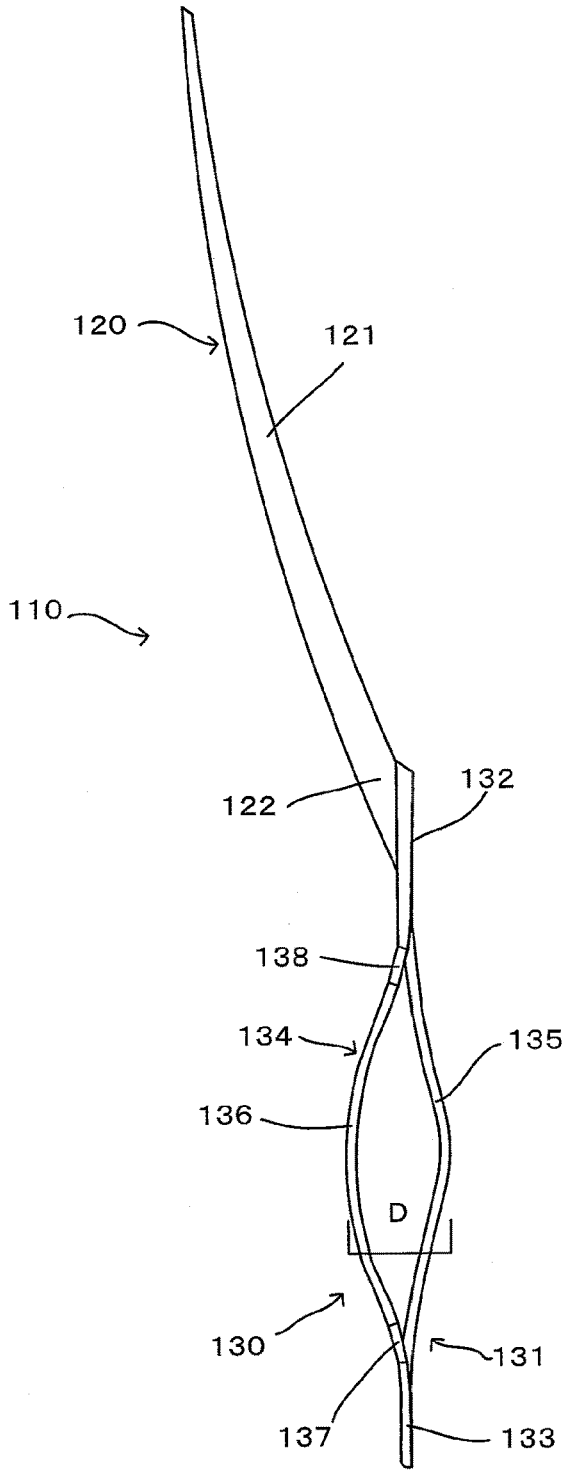
FIG. 3 is a side view of the cleaning element holder.

As shown in FIGS. 2 and 3, the cleaning element holder 110 mainly includes a handle part 120 and a cleaning element holding part 130. The handle part 120 is an elongate member to be held by a user during cleaning. The handle part 120 has a handle 121 and a connecting part 122. The connecting part 122 is connected to a base part 132 of the cleaning element holding part 130. The handle 121 extends in an elongate form from the connecting part 122. The handle part 120 is an example embodiment that corresponds to the "grip part" according to this invention. For convenience of explanation, the upper side and the lower side in FIG. 2 are referred to as the right side and the left side of the cleaning element holder 110, respectively, and the upper side and the lower side in FIG. 3 are referred to as the upper side and the lower side of the cleaning element holder 110, respectively.

The cleaning element holding part 130 is a member formed of resin material and configured to hold the cleaning element 140. The cleaning element holding part 130 mainly includes a pair of elongate holding members 131, projections 137, 138 and a retaining plate 139.

Specifically, polypropylene (PP) is used to form the cleaning element holding part 130. Flexible resin materials, such as polyethylene (PE), polyethylene terephthalate (PET), acrylonitrile butadiene styrene (ABS) and thermoplastic polyester elastomer, can be appropriately selected for the cleaning element holding part 130.

The cleaning element holding part 130 and the projections 137, 138 are example embodiments that correspond to the "holding part" and the "projection", respectively, according to this invention.

Each of the holding members 131 extends in a direction opposite to the direction in which the handle 121 extends from the base part 132. Specifically, the holding member 131 has the base part 132, a tip part 133 and an intermediate part 134 extending from the base part 132 to the tip part 133. The tip part 133 of the holding member 131 is a free end.

The intermediate part 134 includes a first elastic member 135 and a second elastic member 136. Specifically, the first elastic member 135 and the second elastic member 136 are connected to each other at the base part 132 and the tip part 133 and configured to be spaced apart from each other in a region of an intermediate portion between the base part 132 and the tip part 133. As shown in FIG. 3, in the region of the intermediate portion between the base part 132 and the tip part 133, the first elastic member 135 is convexly curved to the lower side of the cleaning element holder 110 (downward as viewed in FIG. 3) from the base part 132 and the tip part 133. On the other hand, in this intermediate region, the second elastic member 136 is convexly curved to the upper side of the cleaning element holder 110 (upward as viewed in FIG. 3) from the base part 132 and the tip part 133.

Further, as shown in FIG. 2, the first elastic members 135 of the holding members 131 are arranged to be located closer to each other in the region of the intermediate portion between the base part 132 and the tip part 133, while the second elastic members 136 of the holding members 131 are arranged to be located away from each other in this intermediate region.

The intermediate part 134 having the above-described structure is arranged such that the first elastic member 135 and the second elastic member 136 which form one holding member 131 are most spaced apart from each other in the vertical direction and in the right and left direction of the cleaning element holder 110 in the region of the intermediate portion between the base part 132 and the tip part 133. These distances in the vertical direction and in the right and left direction between the elastic members are indicated by a horizontal distance W in the right and left direction of the cleaning element holder 110 as shown in FIG. 2, and a vertical distance D in the vertical direction of the cleaning element holder 110 as shown in FIG. 3. The first and second elastic members 135, 136 are formed of resin material and configured to bend in the vertical direction and in the right and left direction of the cleaning element holder 110 by elastic deformation. The vertical distance D of the cleaning element holder 110 in its initial state is preferably 250% or more of the distance between the first and second elastic members 135 and 136 which are vertically moved close to each other by elastic deformation.

As shown in FIG. 2, the projections 137, 138 are formed on the lateral outer side surface of the second elastic member 136. Specifically, the projection 137 is formed on the tip part 133 side of the second elastic member 136, and the projection 138 is formed on the base part 132 side of the second elastic member 136. The projections 137, 138 have a semicircular shape in plan view.

The retaining plate 139 protrudes from the base part 132 and extends parallel to the pair holding members 131 therebetween. The retaining plate 139 is a plate-like member convexly curved downward, and further has an engagement lug (not shown) on the underside.

(Structure of the Cleaning Element)

Figure 5:
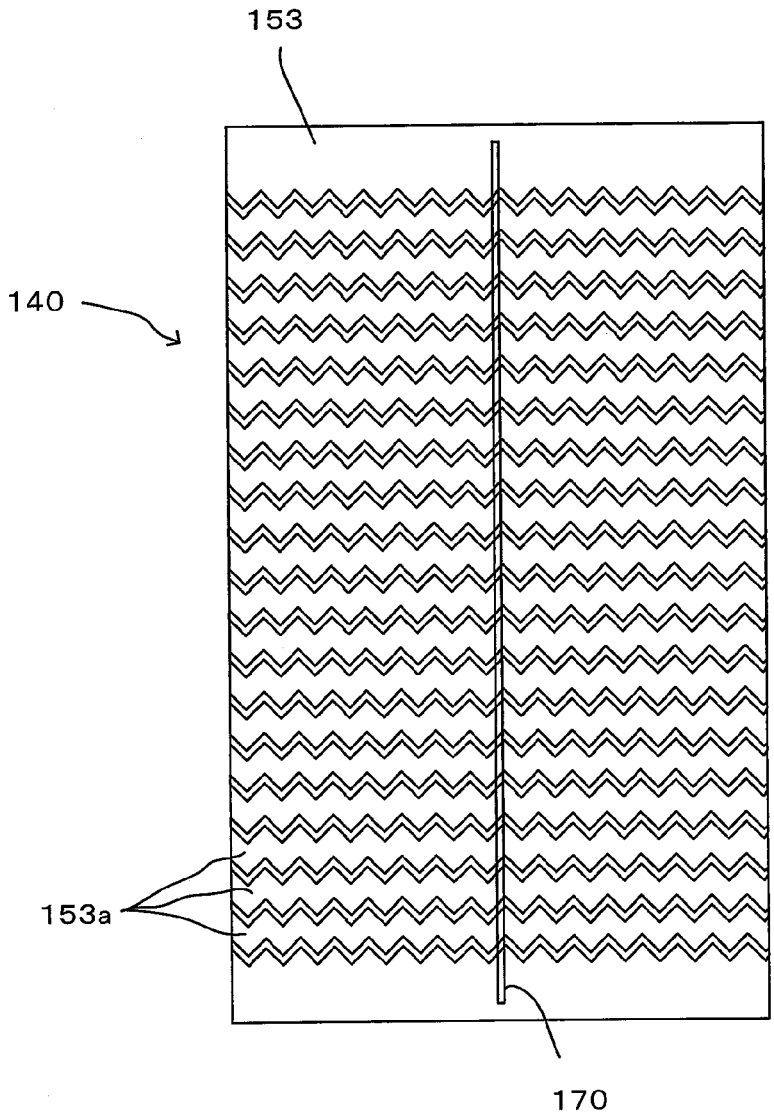
FIG. 5 is a plan view of the cleaning element as viewed from a cleaning surface side.
Figure 6:
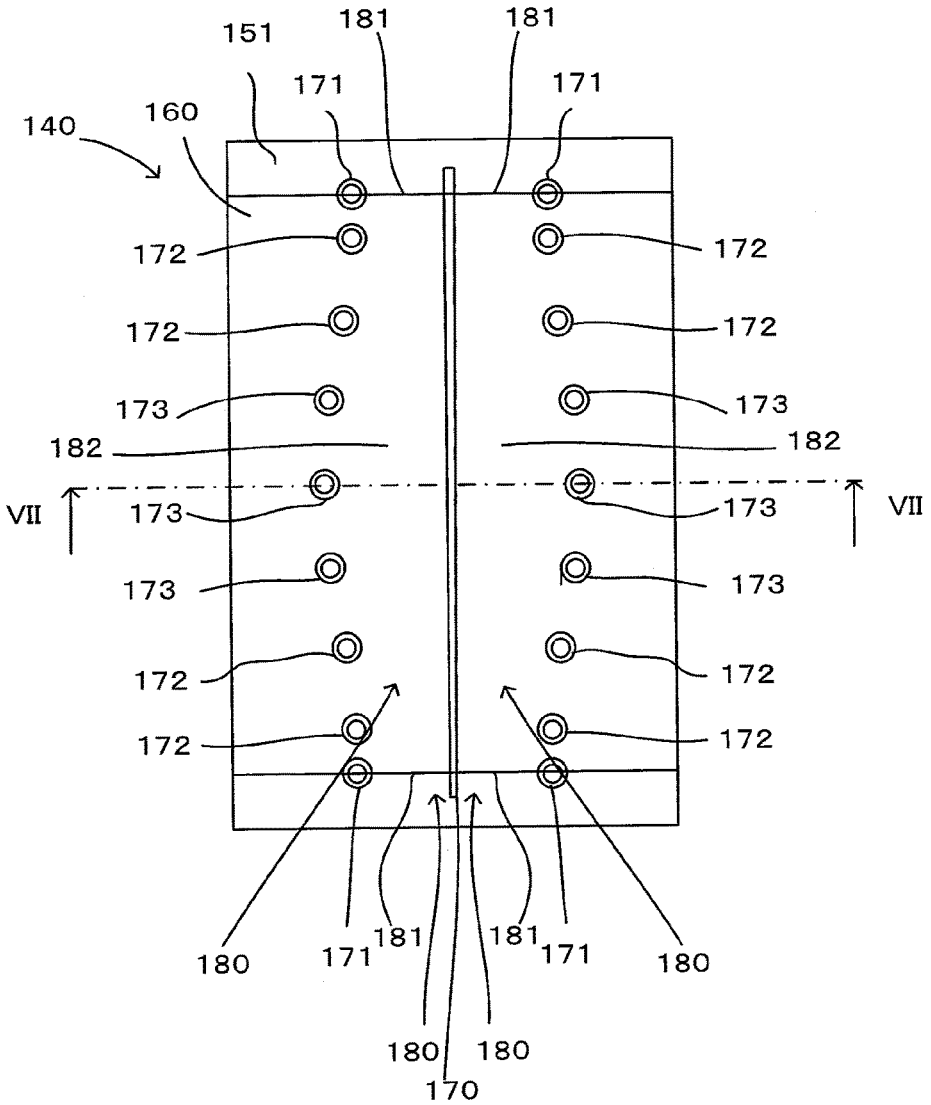
FIG. 6 is a plan view of the cleaning element as viewed from a holding surface side.

The cleaning element 140 is now explained with reference to FIGS. 4 to 7. The cleaning element 140 has a sheet-like form and has a scraping-off function of scraping off dirt on a surface of an object to be cleaned in wipe cleaning. As shown in FIGS. 5 and 6, the cleaning element 140 is rectangular in plan view. The long side direction of the cleaning element 140 substantially coincides with a direction crossing the extending direction of the fibers of the fiber assembly.

Figure 4:
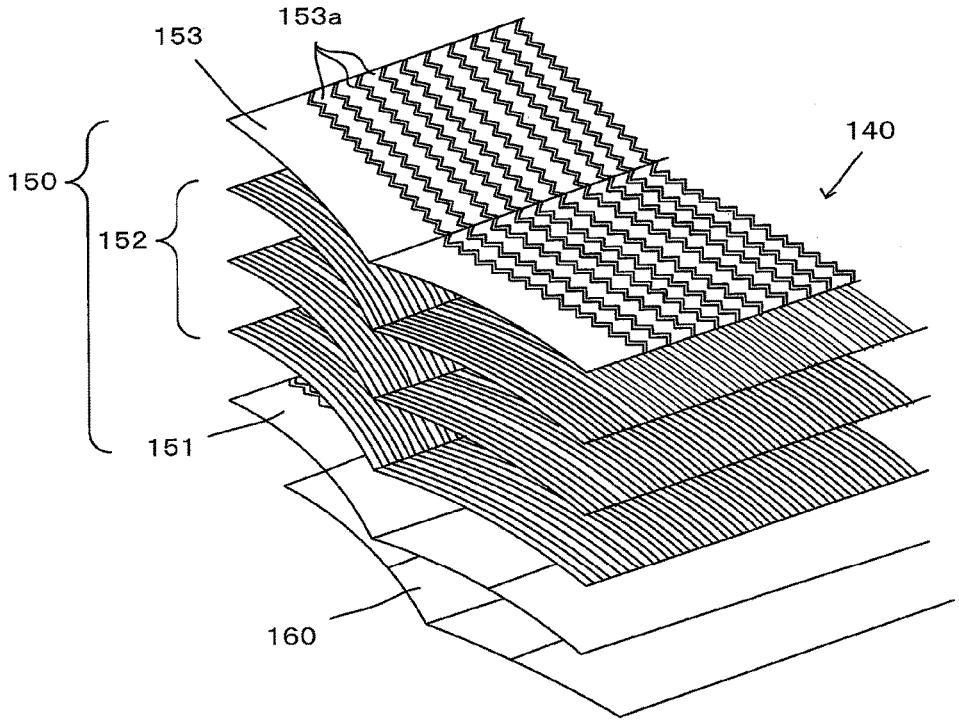
FIG. 4 is an exploded perspective view showing each component of a cleaning element.

As shown in FIG. 4, the cleaning element 140 mainly includes a cleaning element body 150 and a holding sheet 160. The cleaning element 140 may be of disposable type designed for single use, disposable type designed for multiple use which can be used several times, while holding dust or dirt collected from the cleaning surface to be cleaned, or reusable type which can be reused by washing.

The cleaning element body 150 includes a base sheet 151, a fiber assembly 152 and a cleaning side sheet 153 which all have a sheet-like form and are superposed and bonded together. The base sheet 151, the fiber assembly 152 and the cleaning side sheet 153 have the same rectangular shape in plan view, extending in an elongate form in the long side direction of the cleaning element 140. The fiber assembly 152 and the cleaning side sheet 153 form a brush-like part having a dirt scraping-off function, which is also referred to as a "brush part". The fiber assembly 152 is an example embodiment that corresponds to the "fiber assembly" according to this invention.

As shown in FIG. 4, the base sheet 151 and the cleaning side sheet 153 are rectangular nonwoven fabric sheets. The cleaning side sheet 153 has a plurality of zigzag strips 153*a* extending side by side in a short side direction of the cleaning element 140.

As shown in FIG. 4, the fiber assembly 152 is a single fiber structure formed by fibers, a fiber structure having fibers aligned in the length direction and/or the radial direction (twist yarn, spun yarn, yarn to which a plurality of filaments are partially connected), or an assembly of the fiber structures. The fiber assembly 152 contain thermoplastic fibers in part and can be fusion bonded (or welded). The fibers forming the fiber assembly 152 are components of yarn, textile or the like and are thin and flexible fibers having a substantially longer length compared with the thickness. Typically, a long continuous fiber is defined as a filament and a short fiber as a staple.

The fibers of the fiber assembly 152 are bonded on the base end side at a center welding line 170 and welding parts 171, 172, 173, and extend in an elongate form in the short side direction of the cleaning element 140 (or the fiber assembly 152) with the welding parts as fixed ends and its opposite side (tip side) as free ends. The fiber assembly 152 is also referred to as the "fiber bundle" having a plurality of fibers in a bundle. Further, the welding parts 171, 172, 173 form a holding space 180 as described below.

The welding parts 171, 172, 173 are an example embodiment that corresponds to the "first bonded part" according to this invention.

The fiber assembly 152 is formed by three fiber layers, but the number of fiber layers may be one or more other than three as necessary. Preferably, the fiber assembly 152 has a planar structure having a predetermined flat or curved surface and has a three-dimensional form having a certain thickness or has a thin sheet-like form. The fiber assembly 152 is typically formed of polyethylene (PE), polypropylene (PP), polyethylene terephthalate (PET), nylon, rayon or the like. In practical use, an assembly of filaments formed by opening a tow is preferably used as the fiber assembly 152. It is particularly preferable that the fiber assembly 152 comprises conjugated fibers having a core of polypropylene (PP) or polyethylene terephthalate (PET) and a core covering sheath of polyethylene (PE). Further, the fibers 110SF of the fiber assembly 152 preferably have a fineness of 1 to 50 dtex, or more preferably 2 to 10 dtex. Each fiber assembly may contain fibers of substantially the same fineness, or it may contain fibers of different finenesses.

Further, in order to enhance the sweeping-out function during cleaning, it is preferred to use the fiber assembly including the fibers having higher rigidity or the fibers having higher fineness. It is further preferred that the fiber assembly has crimped fibers. Here, the crimped fibers are fibers subjected to a prescribed crimping process and easily intertwined with each other. By provision of the crimped fibers, the fiber assembly becomes bulkier than before the cleaning element holder is attached to the cleaning element, and dust can be easily captured by the crimped portions. This structure can be realized especially by using crimped fibers opened from tows.

As shown in FIG. 6, the holding sheet 160 is a rectangular nonwoven fabric sheet which is shorter than the base sheet 151 in the long side direction of the cleaning element 140.

The base sheet 151, the cleaning side sheet 153 and the holding sheet 160 are typically formed of sheet-like nonwoven fabric comprising thermal melting fibers (thermoplastic fibers). Therefore, the base sheet 151, the cleaning side sheet 153 and the holding sheet 160 are also referred to as "nonwoven fabric sheet" or "sheet member". The sheet member is an example embodiment that corresponds to the "sheet member" according to this invention. In order to enhance the sweeping-out function during cleaning, it is preferred to use the nonwoven fabric having higher rigidity.

Figure 7:
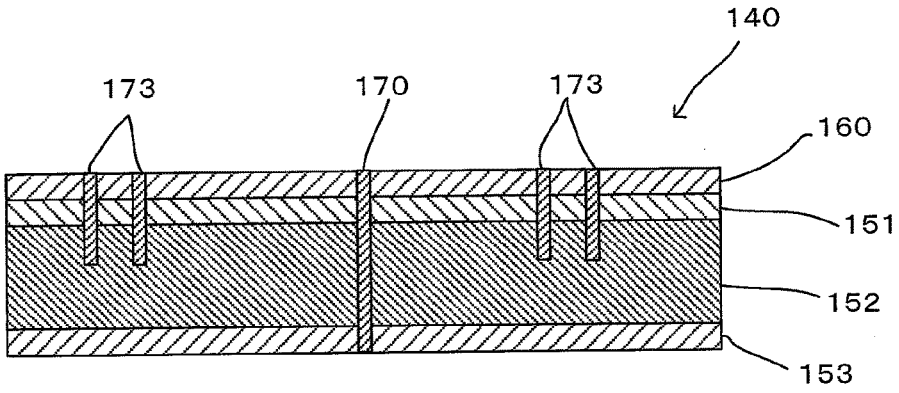
FIG. 7 is a sectional view taken along line VII-VII in FIG. 6.

As shown in FIG. 6, the cleaning element body 150 and the holding sheet 160 are welded at the center welding line 170 extending in the long side direction of the cleaning element 140 through a center of the cleaning element 140, and at a plurality of the circular welding parts 171, 172, 173 arranged on the both sides of the center welding line 170. Specifically, as shown in FIG. 7, the base sheet 151, the fiber assembly 152 and the cleaning side sheet 153 which form the cleaning element body 150, and the holding sheet 160 are welded at the center welding line 170. Further, the base sheet 151 and part of the fiber assembly 152 of the cleaning element body 150 and the holding sheet 160 are welded at the welding parts 171, 172, 173.

By welding the sheets as described above, a pair of holding spaces 180 are formed between the center welding line 170 and the welding parts 171, 172, 173 and extend in the long side direction of the cleaning element 140. Each of the holding spaces 180 has openings 181 on the both ends in the long side direction of the cleaning element 140. The holding space 180 is an example embodiment that corresponds to the "insertion part" according to this invention.

In other words, the holding spaces 180 are defined by a prescribed region of the holding sheet 160 and a prescribed region of the base sheet 151 which extend between the pair welding parts 171, 172, 173. A prescribed region of the holding sheet 160 which is located on the upper side (on the upper side as viewed in FIG. 3) of the cleaning tool 100 in the holding space 180 is defined as a first region 180A. A prescribed region of the base sheet 151 which is located on the lower side (on the lower side as viewed in FIG. 3) of the cleaning tool 100 in the holding space 180 is defined as a second region 180B. The first region 180A and the second region 180B are example embodiments that correspond to the "first region" and the "second region", respectively, according to this invention.

The welding parts 171, 172, 173 are arranged on a curve in the long side direction of the cleaning element 140. Specifically, the welding parts 171 on the opening 181 side are arranged closer to the center welding line 170 in the short side direction of the cleaning element 140. The welding parts 172 are arranged in an intermediate region 182 between the openings 181 formed on the both ends in the long side direction of the cleaning element 140, and arranged further away from the center welding line 170 than the welding parts 171. The welding parts 173 are arranged even further away from the center welding line 170. Thus, the holding space 180 is configured such that the cross-sectional area of the intermediate region 182 is larger than that of the opening 181 in the short side direction of the cleaning element 140. In other words, the holding space 180 is configured to have a larger amount of displacement in the intermediate region 182 than in the opening 181 in a thickness direction of the cleaning element 140.

(Engagement of the Cleaning Element Holder and the Cleaning Element)

Figure 8:
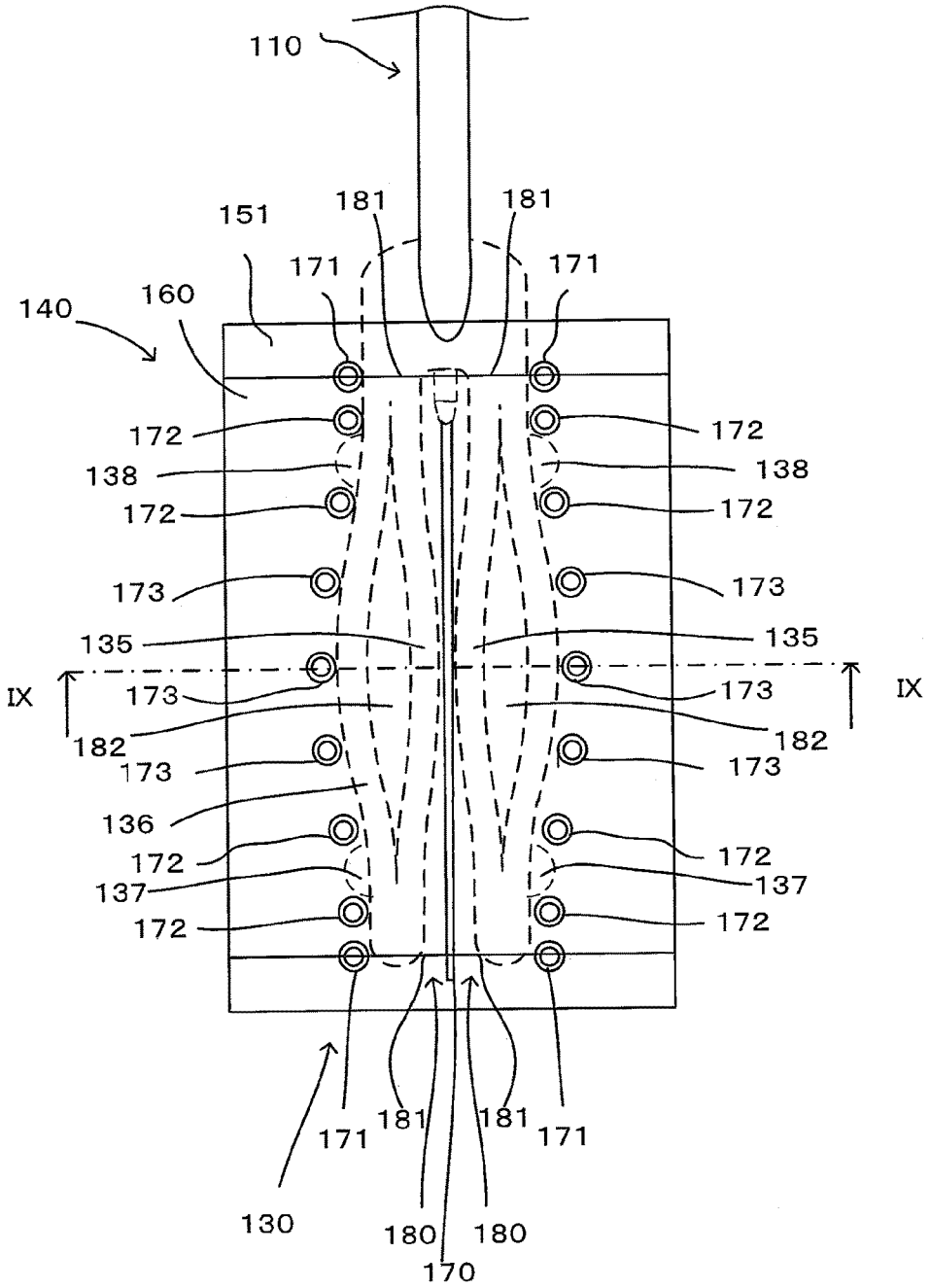
FIG. 8 is a drawing for showing engagement of the cleaning element holder with the cleaning element.
Figure 9:
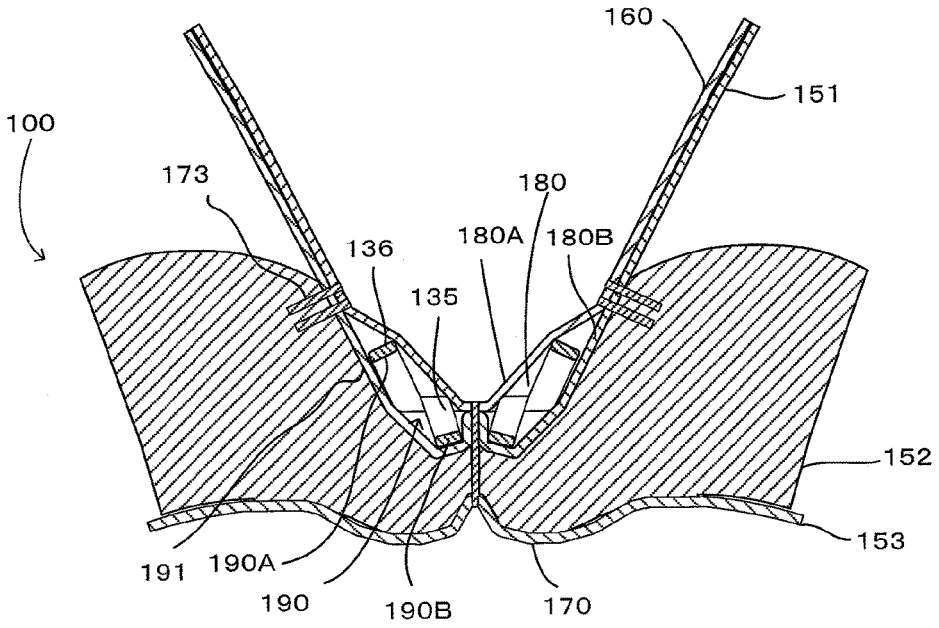
FIG. 9 is a sectional view taken along line IX-IX in FIG. 8.

Engagement of the cleaning element holder 110 and the cleaning element 140 is explained with reference to FIGS. 8 and 9. As shown in FIG. 8, the holding members 131 can be inserted into the holding spaces 180. The cleaning element 140 is held by the cleaning element holder 110 by inserting the holding members 131 into the holding spaces 180.

The width of the opening 181 of the holding space 180 is smaller than a larger one of the horizontal distance W and the vertical distance D between the first elastic member 135 and the second elastic member 136. Therefore, in the process of inserting the holding member 131 into the holding space 180, the first elastic member 135 and the second elastic member 136 elastically deform toward each other when passing through the opening 181.

When inserted through the opening 181, the first elastic member 135 and the second elastic member 136 deform in a direction away from each other in the intermediate region between the base part 132 and the tip part 133 by their restoring forces. Specifically, the elastic members deform so as to return to the initial state. As a result, as shown in FIG. 9, the holding space 180 is vertically expanded by the first and second elastic members 135, 136.

Upon completion of insertion of the holding member 131 into the holding space 180, the projections 137, 138 are held between the welding parts 172. Further, as shown in FIG. 9, the first elastic member 135 pushes the holding sheet 160 upward and the second elastic member 136 pushes the base sheet 151 downward by their respective restoring forces. As a result, as shown in FIG. 8, the holding member 131 is engaged with the intermediate region 182 within the holding space 180. At this time, the retaining plate 139 presses the cleaning element 140 from above, and the engagement lug (not shown) on the underside of the retaining plate 139 serves as a stopper for the cleaning element 140. In this manner, the cleaning element 140 is reliably held by the cleaning element holding part 130. Further, the holding member 131 may be inserted into the holding space 180 from either of the openings 181 formed on the both ends of the cleaning element 140.

According to the above-described embodiment, the cleaning element 140 is held by the cleaning element holder 110 while the cleaning element holding part 130 vertically expands the cleaning element 140. Specifically, the holding member 131 is formed by the elastically deformable first and second elastic members 135, 136, and expands the cleaning element 140 in the thickness direction by the restoring forces of the first and second elastic members 135, 136. Therefore, as shown in FIG. 9, the cleaning element 140 is held in the expanded or bulky state (as shown by dotted lines).

Especially, the fiber assembly 152 is made bulkier. This state of the fiber assembly 152 can be defined as providing a high bulky feeling, and also referred to as a "bulky state", "volume-up state", "high space-fullness state" or "high bulkiness state". The cleaning effect can be enhanced by increasing the bulkiness of the fiber assembly 152. Further, due to the increased bulkiness of the fiber assembly 152, the fiber assembly 152 makes closer contact with a surface to be cleaned. Therefore, dirt of the fiber assembly 152 easily stands out (the fiber assembly 152 is easily blackened), so that the user can get a higher level of satisfaction, realizing that dust or dirt is reliably captured.

Further, according to this embodiment, the first elastic member 135 and the second elastic member 136 are spaced apart from each other not only in the vertical direction of the cleaning element holder 110 but also in the right and left direction of the cleaning element holder 110. Specifically, the first elastic member 135 and the second elastic member 136 not only hold the cleaning element 140 in a bulky state by being spaced apart from each other in the thickness direction of the cleaning element 140, but also ensure the area of the cleaning element 140 in plan view by being spaced apart from each other in a direction crossing the thickness direction of the cleaning element 140. In other words, the cleaning element 140 is held bulky while restricting reduction of the area of the cleaning element 140 in plan view. Therefore, the cleaning element 140 can be held bulky in a wider range, so that the cleaning efficiency can be enhanced.

The cleaning element 140 is held by the cleaning element holder 110 while the holding member 131 presses against the cleaning element 140 in a direction to expand an internal space of the holding space 180. Specifically, the first elastic member 135 of the holding member 131 presses against the second region 180B of the holding space 180 and the second elastic member 136 of the holding member 131 presses against the first region 180A of the holding space 180. As a result, tension is applied to the first region 180A and the second region 180B in the holding space 180. Specifically, the first elastic member 135 and the second elastic member 136 of the holding member 131 are formed as a tension applying part 190 for applying prescribed tension, particularly to the second region 180B in the holding space 180. Further, the second elastic member 136 and the first elastic member 135 are formed as a first tension applying part 190A and a second tension applying part 190B, respectively.

The structure of the holding member 131 is an example embodiment that corresponds to the "tension applying part" according to this invention. Further, the first tension applying part 190A and the second tension applying part 190B are example embodiments that correspond to the "first tension applying part" and the "second tension applying part", respectively, according to this invention.

The first elastic member 135 is disposed inward of the second elastic member 136 in the transverse direction X. Specifically, the second tension applying part 190B is disposed inward of the first tension applying part 190A in the transverse direction X. This is an example embodiment that corresponds to the feature that "the second tension applying part is disposed inward of the first tension applying part in the transverse direction" according to this invention.

Therefore, the second region 180B is inclined from the second tension applying part 190B (the first elastic member 135) to the first tension applying part 190A (the second elastic member 136) while tension is applied to the second region 180B in an upward direction (upward as viewed in FIG. 3). Thus, the second region 180B forms a tension part 191. The tension part 191 is an example embodiment that corresponds to the "tension part" according to this invention.

Thus, the second region 180B is inclined in a direction toward the first region 180A (upward as viewed in FIG. 3). Further, the sheet member (the base sheet 151, the holding sheet 160) contiguous to the second region 180B is also moved in the direction toward the first region 180A (upward as viewed in FIG. 3). This is an example embodiment that corresponds to the feature that "when the holding part of the holder is inserted into the insertion part of the cleaning sheet, the tension applying part of the holding part applies tension to the second region of the cleaning sheet so that the second region forms a tension part, and the sheet member extending in the transverse direction in the tension part is moved in a direction toward the first region" according to this invention.

As a result, in the cleaning element 140, the distance between the sheet member (the base sheet 151, the holding sheet 160) and the cleaning side sheet 153 is expanded. Therefore, a region of the cleaning element 140 to get into contact with the object to be cleaned can be increased.

Further, in the cleaning tool 100 having the fiber assembly 152 of this type, the user may open the fiber assembly 152 by shaking the cleaning tool 100 before use. In the present invention, a region of the fiber assembly 152 to be opened can be ensured, so that the opened state of the fiber assembly 152 is excellent.

Further, the cleaning element holding part 130 has a bifurcated shape having a pair of the holding members 131, so that reduction of the area of the cleaning element 140 in plan view can be further restricted while the cleaning element 140 is held in the bulky state.

Further, according to this embodiment, the first elastic member 135 and the second elastic member 136 are most spaced apart from each other in the vertical direction and in the right and left direction of the cleaning element holder 110 in the intermediate portion which is located at an equal distance from the base part 132 and the tip part 133. Therefore, the cleaning element 140 held by the cleaning element holder 110 can be made bulkiest in its center. Thus, the cleaning element 140 can be efficiently held bulky.

Further, according to this embodiment, with the cleaning element 140 held by the cleaning element holder 110, the holding member 131 is engaged with the intermediate region 182 within the holding space 180 by the restoring forces of the first and second elastic members 135, 136. Specifically, by the restoring forces of the first and second elastic members 135, 136, the cleaning element 140 can be prevented from coming off the cleaning element holder 110 during cleaning.

Further, according to this embodiment, with the structure in which the cleaning side sheet 153 has the strips 153*a*, the fibers of the fiber assembly 152 can be easily entangled with the strips 153*a* of the cleaning side sheet 153. Specifically, by entanglement of the fibers with the strips 153*a* on a side of the cleaning element 140 facing the object to be cleaned, the side of the cleaning element 140 facing the object to be cleaned can be made bulkier. Therefore, the cleaning function of capturing dust or dirt can be further enhanced.

In this embodiment, preferably, the welding parts 171, 172, 173 are arranged symmetrically not only with respect to the center welding line 170 but also with respect to a line passing through the center of the center welding line 170 and perpendicular to the center welding line 170. With this structure, the holding member 131 can be inserted into the holding space 180 from either of the openings 181.

The present invention is not limited to the embodiment as described above, but rather, may be added to, changed, replaced with alternatives or otherwise modified. For example, the following modifications can also be performed in application of the above-described embodiment.

(First Modification)

Figure 10:
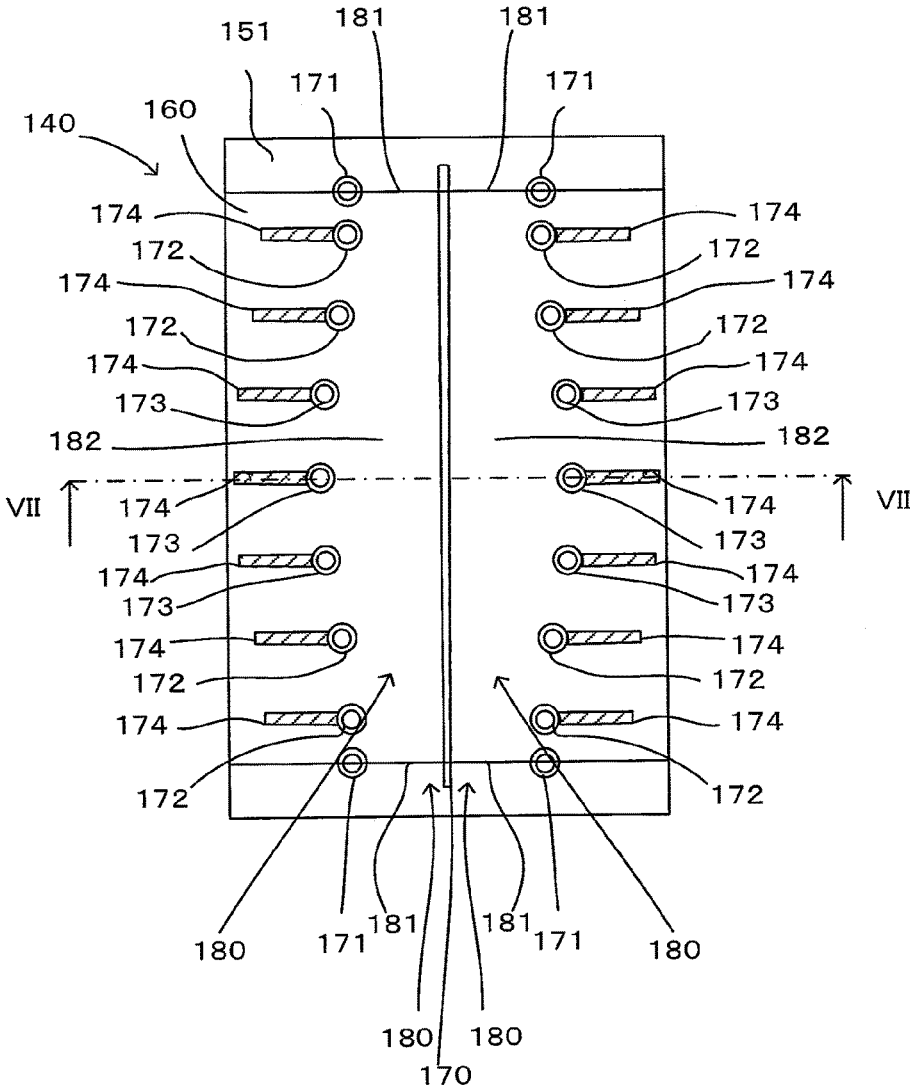
FIG. 10 is a plan view corresponding to FIG. 6 according to a first modification of the present invention.
Figure 11:
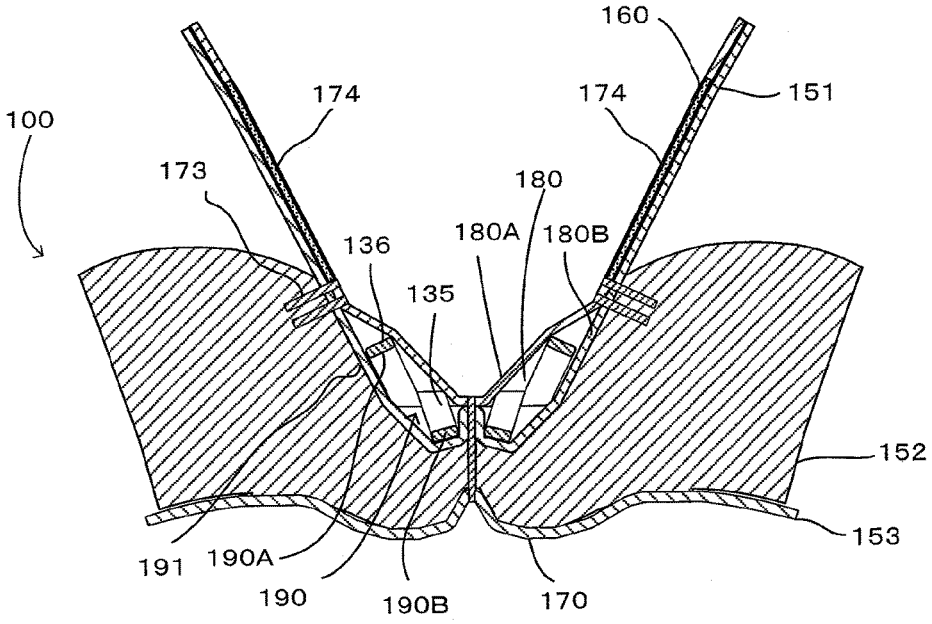
FIG. 11 is a sectional view corresponding to FIG. 9 according to the first modification of the present invention.

The first modification is now explained with reference to FIGS. 10 and 11. In the cleaning element 140 of the cleaning tool according to the first modification, the sheet member (the base sheet 151, the holding sheet 160) is provided with a high-rigidity region 174. Further, a region of the sheet member (the base sheet 151, the holding sheet 160) not having the high-rigidity region 174 is referred to as a low-rigidity region. The high-rigidity region 174 and the low-rigidity region are example embodiments that correspond to the "high-rigidity region" and the "low-rigidity region", respectively, according to this invention. The high-rigidity region 174 may be provided in either the holding sheet 160 or the base sheet 151, or it can be provided in both of the holding sheet 160 and the base sheet 151.

The high-rigidity region 174 continuously extends in the transverse direction X. By provision of such a structure, the sheet member (the base sheet 151, the holding sheet 160) can be more reliably moved in the direction toward the first region 180A (upward as viewed in FIG. 3).

Further, the welding parts 171, 172, 173 (the first bonded part) are formed to be contiguous to the high-rigidity region 174. By provision of such a structure, the sheet member (the base sheet 151, the holding sheet 160) can be even more reliably moved in the direction toward the first region 180A (upward as viewed in FIG. 3).

Specifically, the high-rigidity region 174 is formed by applying an adhesive such as a hot-melt adhesive to a prescribed region of the sheet member (the base sheet 151, the holding sheet 160).

Further, the high-rigidity region 174 is formed by sticking s nonwoven fabric which is formed into a prescribed size, on a prescribed region of the sheet member (the base sheet 151, the holding sheet 160).

The high-rigidity region 174 is formed by the second bonded part which is formed by welding the prescribed region of the sheet member (the base sheet 151, the holding sheet 160). The high-rigidity region 174 or the second bonded region is an example embodiment that corresponds to the "second bonded region" according to this invention.

(Second Modification)

Figure 12:
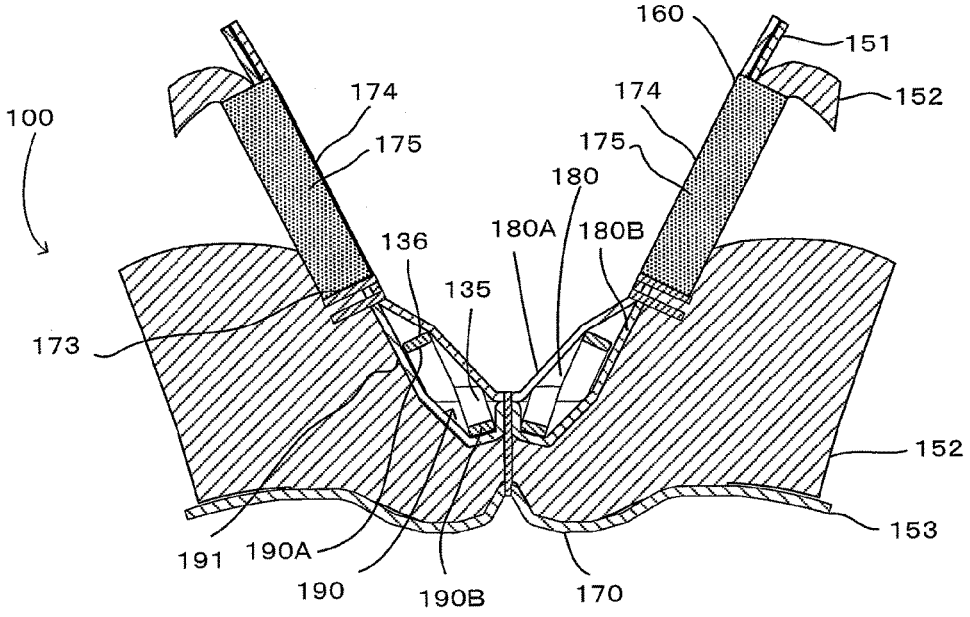
FIG. 12 is a sectional view corresponding to FIG. 9 according to a second modification to the present invention.

A second modification is now explained with reference to FIG. 12. In the cleaning tool according to the second modification, the high-rigidity region 174 of the sheet member (the base sheet 151, the holding sheet 160) is formed by a second bonded part 175. In this case, part of the fiber assembly 152 can be welded to the second bonded part 175.

Therefore, part of the fiber assembly 152 is connected to the strips 153*a* where the second bonded part 175 exists. Thus, when a cleaning operation is performed using the sheet member (the base sheet 151, the holding sheet 160), the possibility of capturing dust or dirt with the fiber assembly 152 is increased.

(Third Modification)

A third modification is now explained with reference to FIG. 13.

Figure 13:
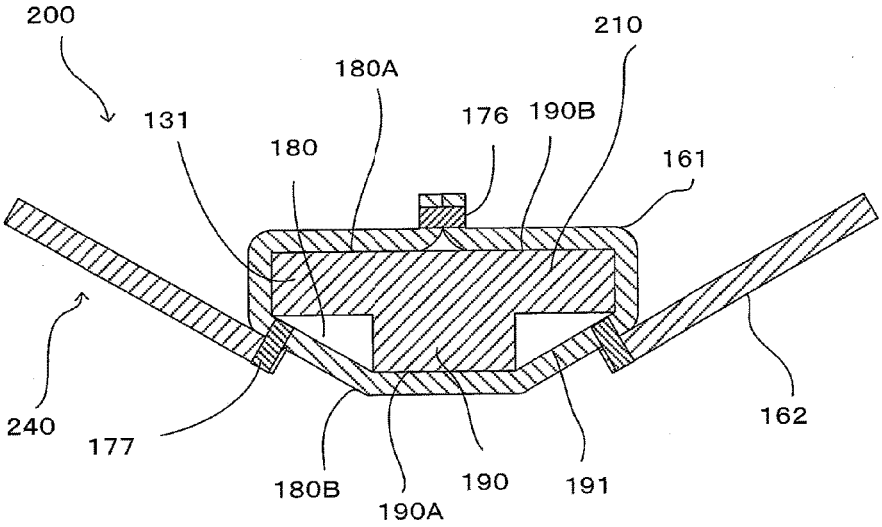
FIG. 13 is a sectional view corresponding to FIG. 9 according to a third modification of the present invention.
Figure 14:
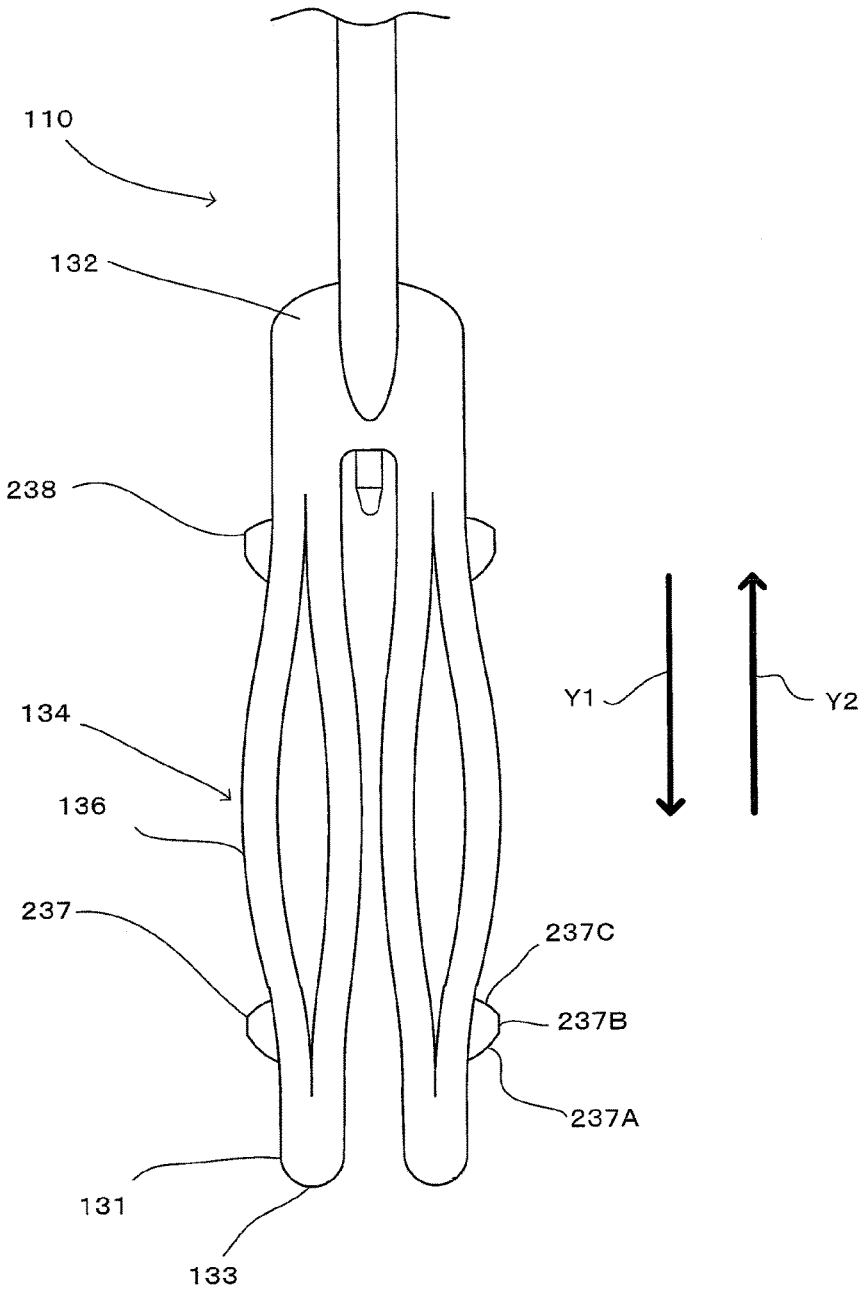
FIG. 14 is a plan view of a fourth modification of the present invention.

A cleaning tool 200 shown in FIG. 13 includes a cleaning element holder 210 and a cleaning element 240. The cleaning element holder 210 has the holding member 131. The holding member 131 is configured to have a single elongate form extending in the longitudinal direction Y and forms the tension applying part 190. Specifically, one side (upper side as viewed in FIG. 13) of the holding member 131 in the thickness direction forms the first tension applying part 190A. Further, the holding member 131 has a projection on the other side (lower side as viewed in FIG. 13) in the thickness direction. This projection forms the second tension applying part 190B.

The holding space 180 in the cleaning element 240 of the cleaning tool 200 is formed by bonding both ends of a single sheet-like member or a holding space sheet 161 to each other at a welding part 176. Even in such a structure, the first and second regions 180A, 180B of the holding space 180 according to the present invention can be formed. Further, a brush sheet 162 forming the brush part is bonded to the holding space sheet 161 at a welding part 177.

When the cleaning element 240 is held by the cleaning element holder 210, the holding member 131 presses against the cleaning element 240 in a direction to expand an internal space of the holding space 180. Specifically, the first tension applying part 190A of the holding member 131 presses against the first region 180A of the holding space 180 and the second tension applying part 190B of the holding member 131 presses against the second region 180B of the holding space 180. As a result, tension is applied to the first and second regions 180A, 180B in the holding space 180.

Further, the second tension applying part 190B is disposed inward of the first tension applying part 190A in the transverse direction X.

Therefore, the second region 180B is inclined from the second tension applying part 190B to the first tension applying part 190A (the second elastic member 136) while tension is applied to the second region 180B in an upward direction (upward as viewed in FIG. 13). Specifically, the second region 180B forms the tension part 191.

As a result, the second region 180B is inclined in a direction toward the first region 180A (upward as viewed in FIG. 13). Further, the brush sheet 160 contiguous to the second region 180B is also moved in the direction toward the first region 180A (upward as viewed in FIG. 13).

(Fourth Modification)

A fourth modification is now explained with reference to FIGS. 14 to 23. The second elastic member 136 has projections 237, 238. The projection 237 is formed on the tip part 133 side of the second elastic member 136, and the projection 238 is formed on the base part 132 side of the second elastic member 136.

An inserting direction Y1 is a direction in which the holding member 131 of the cleaning element holder 110 is inserted into the holding space 180 of the cleaning element 140. The inserting direction Y1 is an example embodiment that corresponds to the "inserting direction" according to this invention.

A pulling-out direction Y2 is a direction in which the holding member 131 of the cleaning element holder 110 is pulled out of the holding space 180 of the cleaning element 140. The pulling-out direction Y2 is opposite to the inserting direction Y1. The pulling-out direction Y2 is an example embodiment that corresponds to the "pulling-out direction" according to this invention.

The projection 237 has an inserting side region 237A on a front side in the inserting direction Y1 and a pulling-out side region 237C on a front side in the pulling-out direction Y2. Further, the projection 237 has an intermediate region 237B between the inserting side region 237A and the pulling-out side region 237C. The inserting side region 237A, the intermediate region 237B and the pulling-out side region 237C are example embodiments that correspond to the "inserting side region", the "intermediate region" and the "pulling-out side region", respectively, according to this invention.

The structure of the projection 237 is now explained. For the sake of convenience, only the structure of the projection 237 on the tip part 133 side is explained. Naturally, the projection 238 on the base part 132 side has the same structure as the projection 237.

Figure 15:
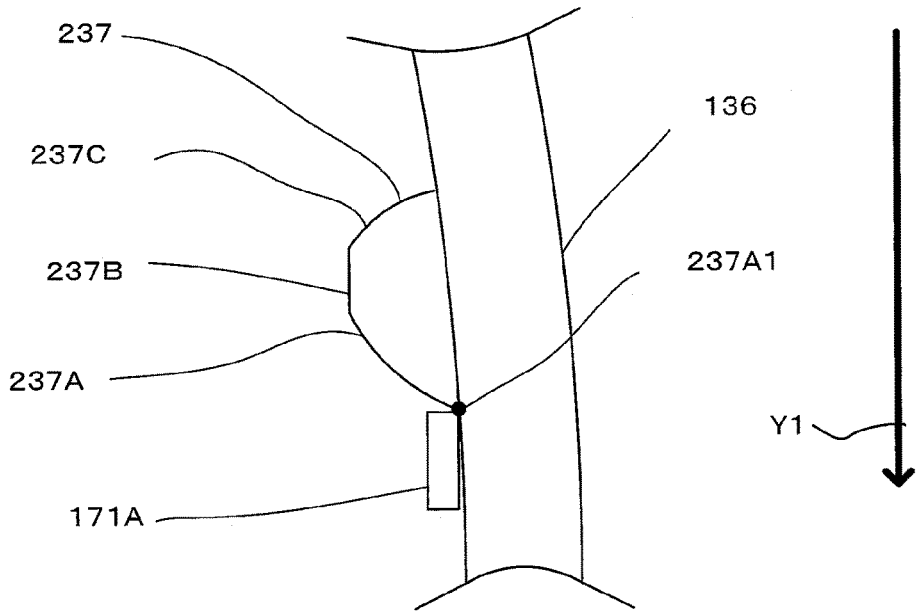
FIG. 15 is an explanatory drawing of the fourth modification of the present invention.

FIG. 15 shows the state at the beginning of inserting the holding member 131 of the cleaning element holder 110 into the holding space 180 of the cleaning element 140 by moving the cleaning element holder 110 in the inserting direction Y1.

At this time, the inserting side region 237A of the projection 237 gets into contact with a bonded part 171A of the cleaning element 140. A point where the inserting side region 237A first gets into contact with the bonded part 171A is defined as an insertion starting point 237A1. The insertion starting point 237A1 is an example embodiment that corresponds to the "insertion starting point" according to this invention.

Figure 16:
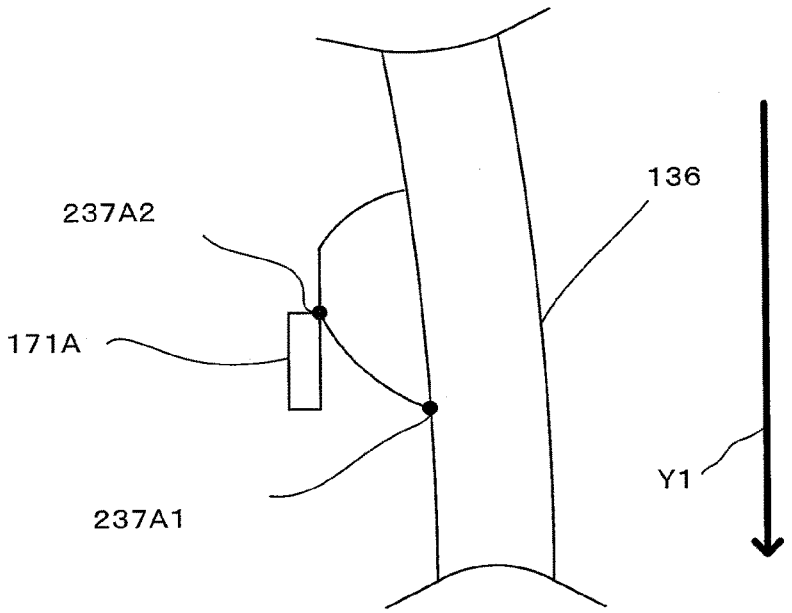
FIG. 16 is an explanatory drawing of the fourth modification of the present invention.

Then, as shown in FIG. 16, the cleaning element holder 110 is further moved in the inserting direction Y1 up to an end point of contact of the inserting side region 237A with the bonded part 171A, which point is defined as an insertion end point 237A2. The insertion end point 237A2 is an example embodiment that corresponds to the "insertion end point" according to this invention.

Figure 17:
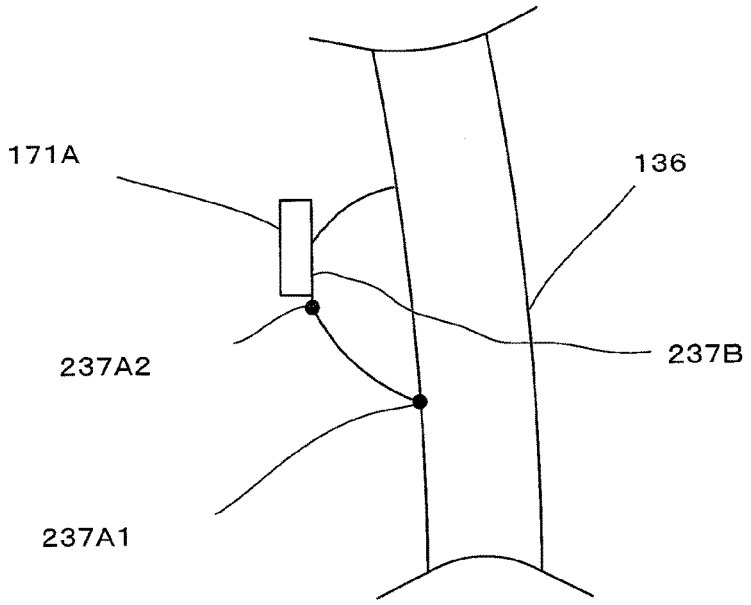
FIG. 17 is an explanatory drawing of the fourth modification of the present invention.

Next, as shown in FIG. 17, the cleaning element holder 110 is further moved in the inserting direction Y1. The bonded part 171A then gets into contact with the intermediate region 237B, while passing through the insertion end point 237A2. Then by further moving the cleaning element holder 110 in the inserting direction Y1, attachment of the cleaning element holder 110 to the cleaning element 140 is completed.

Figure 18:
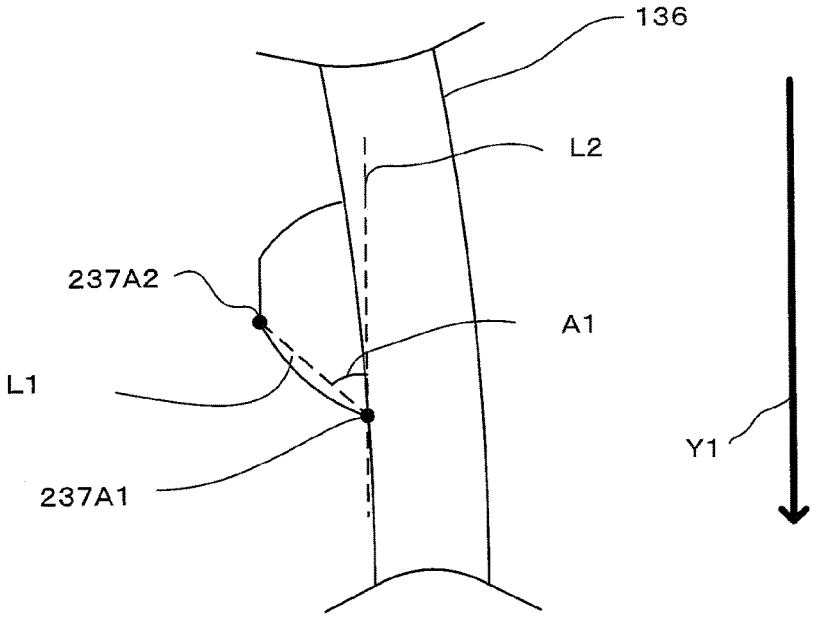
FIG. 18 is an explanatory drawing of the fourth modification of the present invention.

Here, as shown in FIG. 18, a line connecting the insertion starting point 237A1 and the insertion end point 237A2 is defined as a first virtual line L1. A line parallel to the inserting direction Y1 and passing through the insertion starting point 237A1 is defined as a second virtual line L2. Further, an angle made by the first virtual line L1 and the second virtual line L2 is defined as a first angle A1.

The first virtual line L1, the second virtual line L2 and the first angle A1 are example embodiments that correspond to the "first virtual line", the "second virtual line" and the "first angle", respectively, according to this invention.

Figure 19:
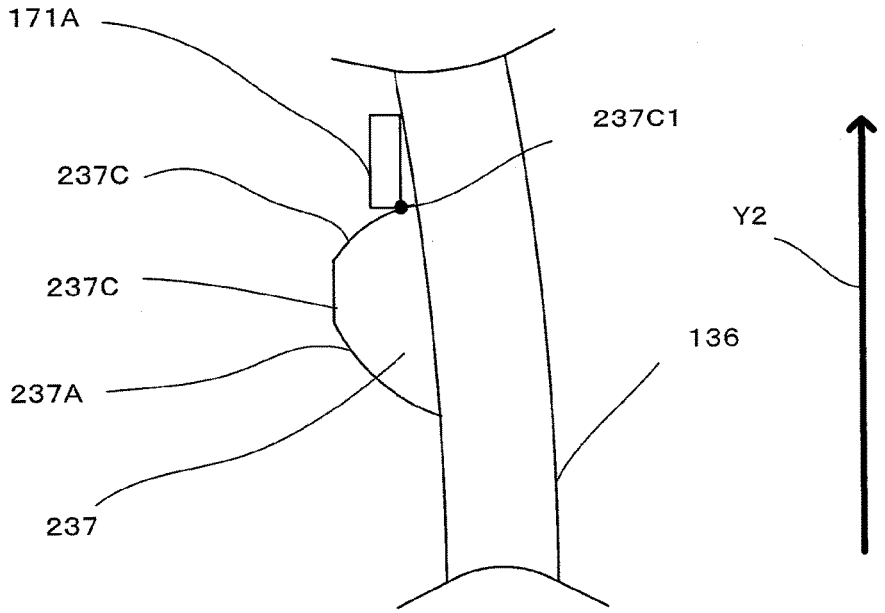
FIG. 19 is an explanatory drawing of the fourth modification of the present invention.

FIG. 19 shows the state at the beginning of moving the cleaning element holder 110 attached to the cleaning element 140 in the pulling-out direction Y2.

At this time, the pulling-out side region 237C of the projection 237 gets into contact with the bonded part 171A of the cleaning element 140. A point where the pulling-out side region 237C first gets into contact with the bonded part 171A is defined as a pulling-out starting point 237C1. The pulling-out starting point 237C1 is an example embodiment that corresponds to the "pulling-out starting point" according to this invention.

Figure 20:
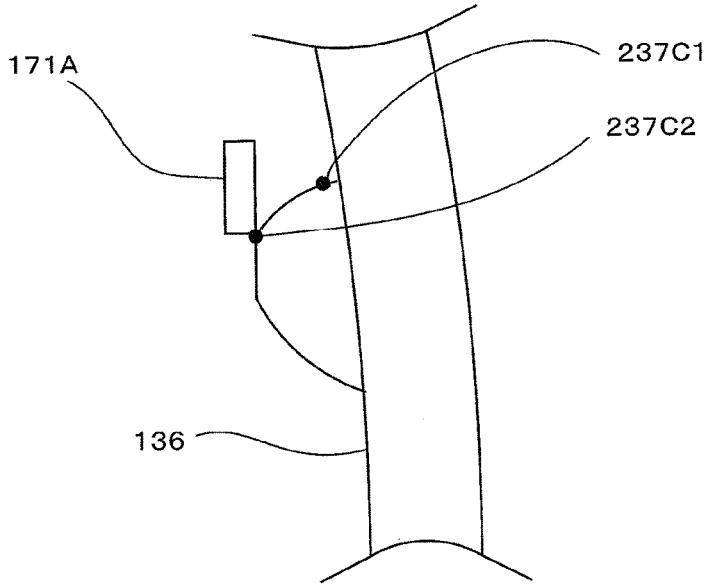
FIG. 20 is an explanatory drawing of the fourth modification of the present invention.

Then, as shown in FIG. 20, the cleaning element holder 110 is further moved in the pulling-out direction Y2 up to an end point of contact of the pulling-out side region 237C with the bonded part 171A, which point is defined as a pulling-out end point 237C2. The pulling-out end point 237C2 is an example embodiment that corresponds to the "pulling-out end point" according to this invention.

Figure 21:
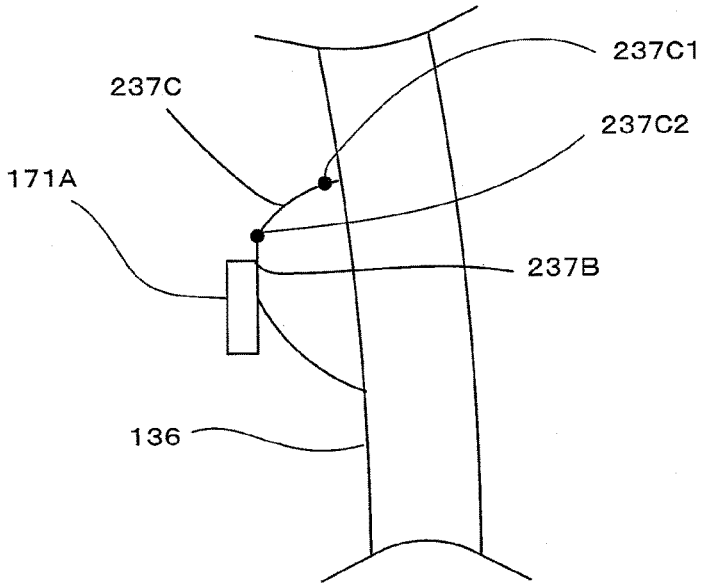
FIG. 21 is an explanatory drawing of the fourth modification of the present invention.

Next, as shown in FIG. 21, the cleaning element holder 110 is further moved in the pulling-out direction Y2. The bonded part 171A then gets into contact with the intermediate region 237B, while passing through the pulling-out end point 237C2. Then by further moving the cleaning element holder 110 in the pulling-out direction Y2, the cleaning element holder 110 is detached from the cleaning element 140.

Figure 22:
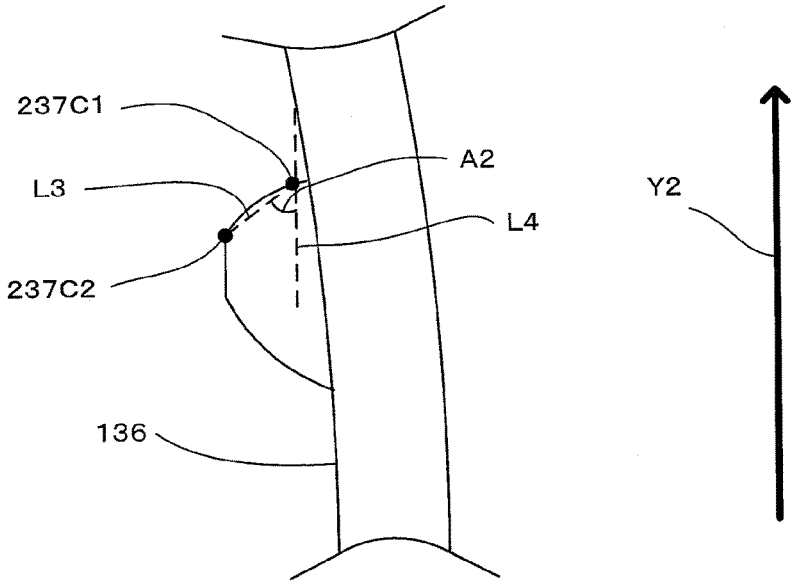
FIG. 22 is an explanatory drawing of the fourth modification of the present invention.

Here, as shown in FIG. 22, a line connecting the pulling-out starting point 237C 1 and the pulling-out end point 237C2 is defined as a third virtual line L3. A line parallel to the pulling-out direction Y2 and passing through the pulling-out starting point 237C1 is defined as a fourth virtual line L4. Further, an angle made by the third virtual line L3 and the fourth virtual line L4 is defined as a second angle A2.

The third virtual line L3, the fourth virtual line L4 and the second angle A2 are example embodiments that correspond to the "third virtual line", the "fourth virtual line" and the "second angle", respectively, according to this invention.

Figure 23:
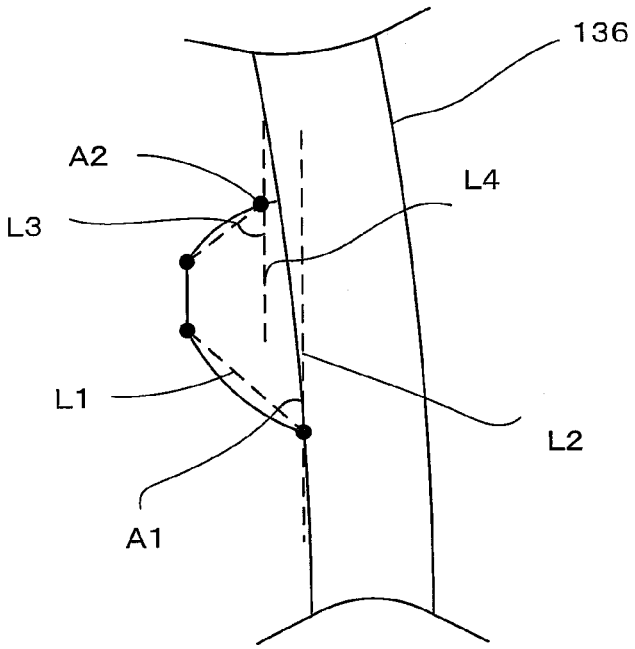
FIG. 23 is an explanatory drawing of the fourth modification of the present invention.

Here, as shown in FIG. 23, the first angle A1 is smaller than the second angle A2. This feature is an example embodiment that corresponds to the feature that "the first angle is smaller than the second angle" according to this invention.

By providing the projection 237 having such a structure, the cleaning element holder 110 can be smoothly attached to the cleaning element 140. Further, the cleaning element holder 110 is not easily separated from the cleaning element 140 during use of the cleaning tool 100.

(Fifth Modification)

Figure 24:
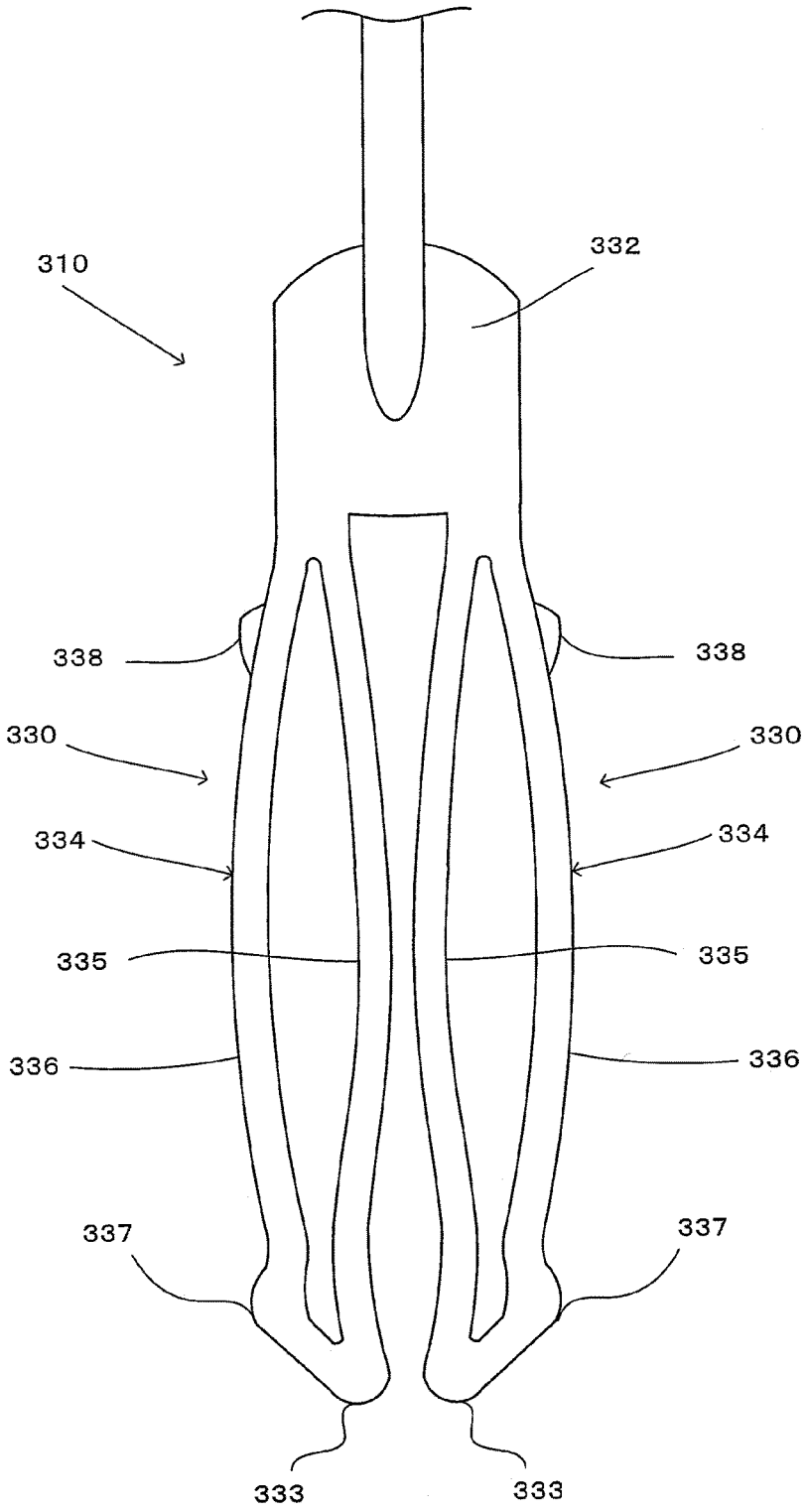
FIG. 24 is a plan view of a fifth modification of the present invention.

A fifth modification is explained with reference to FIGS. 24 and 25. A cleaning element holding part 330 of a cleaning element holder 310 according to the fifth modification includes a first elastic member 335 and a second elastic member 336. The second elastic member 336 has a projection 337 on a tip part 333 side and a projection 338 on a base part 332 side. The projection 337 on the tip part 333 side is formed by deforming a region of the second elastic member 336 on the tip part 333 side in the outside direction.

Specifically, the projection 337 on the tip part 333 side of the cleaning element holder 310 according to the fifth modification has an unclear boundary with the second elastic member 336, compared with projection 237 on the tip part 133 side of the cleaning element holder 110 according to the fourth modification.

As for the projection 337 having such a structure, especially a starting point of an inserting side region 337A of the projection 337 needs to be discussed.

Therefore, how to obtain the "first angle" of the projection 337 having the above-described structure is explained with reference to FIG. 25.

Figure 25:
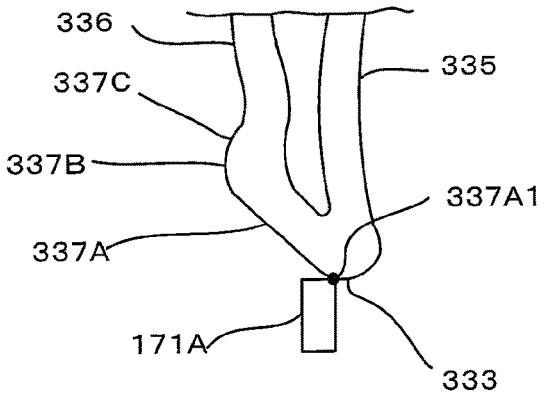
FIG. 25 is an explanatory drawing of the fifth modification of the present invention.

FIG. 25 shows the state at the beginning of inserting the holding member 331 of the cleaning element holder 310 into the holding space 180 of the cleaning element 140 by moving the cleaning element holder 310 in the inserting direction Y1.

At this time, an inserting side region 337A of the projection 337 gets into contact with a bonded part 171A of the cleaning element 140. A point where the inserting side region 337A first gets into contact with the bonded part 171A is defined as an insertion starting point 337A1. A part of the projection 337 extending from the insertion starting point 337A1 to an intermediate part 337B is defined as an inserting side region 337A.

In this manner, even in the structure of the projection 337, like in the above-described fourth modification, the insertion starting point 337A1 and an insertion end point can be identified, so that the first angle of the projection 337 can be obtained.

(Sixth Modification)

Figure 26:
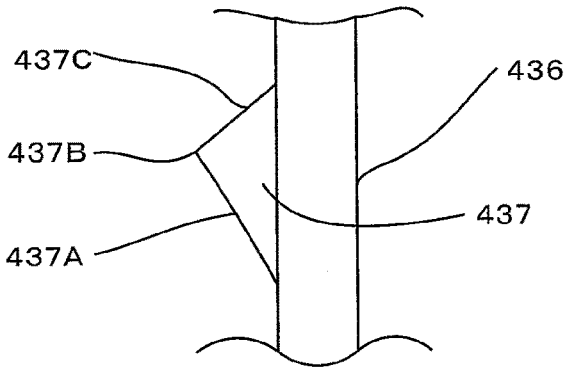
FIG. 26 is an explanatory drawing of a sixth modification of the present invention.

A sixth modification is explained with reference to FIGS. 26 and 27. For the sake of convenience, only the structure of a projection 437 on the tip part side of a second elastic member 436 is shown and explained.

The projection 437 has a straight inserting side region 437A, a straight pulling-out side region 437C and a point-like intermediate region 437B.

Figure 27:
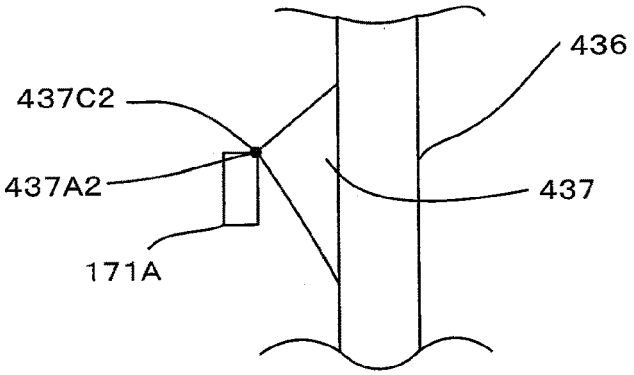
FIG. 27 is an explanatory drawing of the sixth modification of the present invention.

FIG. 27 is an explanatory drawing for showing both the state in which the holding member of the cleaning element holder is inserted into the holding space 180 of the cleaning element 140 by moving the cleaning element holder in the inserting direction Y1 and the state in which the holding member of the cleaning element holder is pulled out of the holding space 180 of the cleaning element 140 by moving the cleaning element holder in the pulling-out direction Y2.

In the projection 437 having such a structure, an insertion end point 437A2 coincides with a pulling-out end point 437C2 at the intermediate region 437B. Even in such a structure in which the insertion end point 437A2 coincides with the pulling-out end point 437C2 at a point on the projection 437, there arises no problem in obtaining the "first angle" and the "second angle".

(Seventh Modification)

Figure 28:
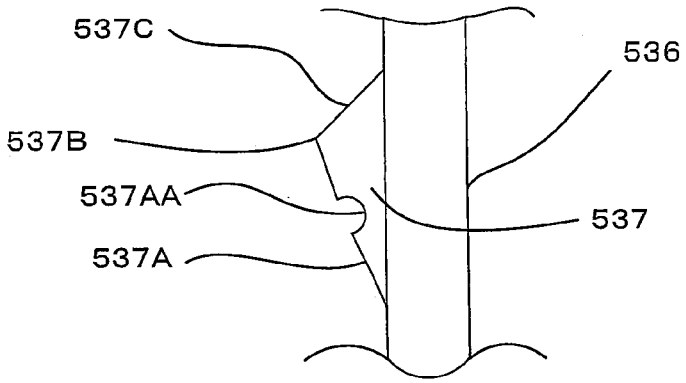
FIG. 28 is an explanatory drawing of a seventh modification of the present invention.

A seventh modification is explained with reference to FIGS. 28 and 29. For the sake of convenience, only the structure of a projection 537 on the tip part side of a second elastic member 536 is shown and explained.

The projection 537 has a recess 537AA in an inserting side region 537A.

Figure 29:
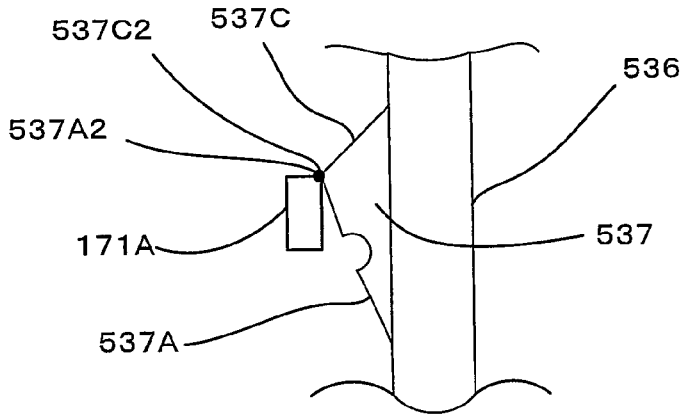
FIG. 29 is an explanatory drawing of the seventh modification of the present invention.

FIG. 29 is an explanatory drawing for showing the state in which the holding member of the cleaning element holder is inserted into the holding space 180 of the cleaning element 140 by moving the cleaning element holder in the inserting direction Y1.

Due to existence of the recess 537AA, the state of contact between the inserting side region 537A and the bonded part 171A in the projection 537 is different from that in the above-described third to fifth modifications.

Specifically, the bonded part 171A passes through the recess 537AA on the way from an insertion starting point (not shown) to an insertion end point 537A2 on an inserting side region 537A of the projection 537.

Even in such a structure having the recess 537AA in the inserting side region 537A, the insertion end point 537A2 is an end point of contact of the inserting side region 537A with the bonded part 171A. The same is true for a structure in which a pulling-out side region 537C has a recess.

Therefore, even in the structure having the recess 537AA in the projection 537, there arises no problem in obtaining the "first angle" and the "second angle".

The fourth to seventh modifications shown in FIGS. 14 to 29 are explained above, focusing on the structure of the projection on the tip part side. Naturally, the above-described structure of the projection on the tip part side can be appropriately applied to the projection on the base part side.

Further, in the fourth to seventh modifications shown in FIGS. 14 to 29, for the sake of convenience, only the "bonded part 171A" is explained as a bonded part of the cleaning element which comes in contact with the projection of the cleaning element holder. Naturally, when obtaining the first and second angles A1, A2, these modifications can also be appropriately applied to bonded parts having various shapes and assemblies of bonded parts arranged in various ways.

In such a case, for example, depending on the shape of the bonded parts and arrangement of a plurality of the bonded parts in the cleaning element and the structure of the intermediate part of the cleaning element holder, the bonded parts arranged continuously in the longitudinal direction may have different first angles A1 and second angles A2.

When varying in the first angle A1, a smallest one of the first angles A1 is defined as the "first angle" according to this invention. When varying in the second angle A2, a largest one of the second angles A2 is defined as the "second angle" according to this invention.

In the above-described embodiment and modifications, the cleaning element holder 110 is described as having a bifurcated shape having the two holding members 131, but it may be shaped otherwise, having only one holding member 131.

(Correspondences Between the Features of the Embodiment and the Features of the Invention)

The cleaning tool 100, 200 is an example embodiment that corresponds to the "cleaning tool" according to this invention. The cleaning element 140, 240 is an example embodiment that corresponds to the "cleaning sheet" according to this invention. The cleaning element holder 110, 210, 310 is an example embodiment that corresponds to the "holder" according to this invention. The longitudinal direction Y and the transverse direction X are example embodiments that correspond to the "longitudinal direction" and the "transverse direction", respectively, according to this invention. The first region 180A and the second region 180B are example embodiments that correspond to the "first region" and the "second region", respectively, according to this invention. The holding space 180 is an example embodiment that corresponds to the "insertion part" according to this invention. The base sheet 151, the holding sheet 160 and the brush sheet 162 are example embodiments that correspond to the "sheet member" according to this invention. The cleaning element holding part 130, 330 is an example embodiment that corresponds to the "holding part" according to this invention. The tension applying part 190, the first tension applying part 190A and the second tension applying part 190B are example embodiments that correspond to the "tension applying part", the "first tension applying part" and the "second tension applying part", respectively, according to this invention. The high-rigidity region 174 is an example embodiment that corresponds to the "high-rigidity region" according to this invention. The welding part 171, 172, 173, 171A is an example embodiment that corresponds to the "first bonded part" according to this invention. The second bonded part 175 is an example embodiment that corresponds to the "second bonded part" according to this invention. The inserting direction Y1 and the pulling-out direction Y2 are example embodiments that correspond to the "inserting direction" and the "pulling-out direction", respectively, according to this invention. The projection 137, 138, 237, 238, 337, 338, 437, 537 is an example embodiment that corresponds to the "projection" according to this invention. The inserting side region 237A, 337A, 437A, 537A is an example embodiment that corresponds to the "inserting side region" according to this invention. The pulling-out side region 237C, 337C, 437C, 537C is an example embodiment that corresponds to the "pulling-out side region" according to this invention. The intermediate region 237B, 337B, 437B, 537B is an example embodiment that corresponds to the "intermediate region" according to this invention. The insertion starting point 237A1, 337A1 is an example embodiment that corresponds to the "insertion starting point" according to this invention. The insertion end point 237A2, 437A2, 537A2 is an example embodiment that corresponds to the "insertion end point" according to this invention. The first virtual line L1, the second virtual line L2 and the first angle A1 are example embodiments that correspond to the "first virtual line", the "second virtual line" and the "first angle", respectively, according to this invention. The pulling-out starting point 237C1 is an example embodiment that corresponds to the "pulling-out starting point" according to this invention. The pulling-out end point 237C2, 437C2, 537C2 is an example embodiment that corresponds to the "pulling-out end point" according to this invention. The third virtual line L3, the fourth virtual line L4 and the second angle A2 are example embodiments that correspond to the "third virtual line", the "fourth virtual line" and the "second angle", respectively, according to this invention. The holding member 131 is an example embodiment that corresponds to the "elongate member" according to this invention. The base part 132 is an example embodiment that corresponds to the "connection part" according to this invention. The first elastic member 135, 235 and the second elastic member 136, 236, 336, 436 are example embodiments that correspond to the "two elastic members" according to this invention.

In view of the nature of the above-described invention, a cleaning tool according to this invention can be provided with various features.

(Aspect 1)

A cleaning tool, having a cleaning sheet and a holder for holding the cleaning sheet, wherein:

the cleaning tool has a longitudinal direction in which the holder is inserted into the cleaning sheet and a transverse direction crossing the longitudinal direction, the cleaning sheet has a first region formed by a sheet member, a second region formed by a sheet member, and an insertion part which has an insertion space continuously extending in the longitudinal direction in order to allow the holder to be inserted between the first region and the second region, the holder has a holding part which is inserted into the insertion space of the cleaning sheet and holds the cleaning sheet, a tension applying part which is provided in the holding part and applies prescribed tension to the second region of the cleaning sheet, and a grip part which is connected to the holding part and designed to be held by a user, and when the holding part of the holder is inserted into the insertion part of the cleaning sheet, the tension applying part of the holding part applies tension to the second region of the cleaning sheet so that the second region forms a tension part, and the sheet member extending in the transverse direction in the tension part is moved in a direction toward the first region.

(Aspect 2)

The cleaning tool as defined in aspect 1, wherein the tension applying part includes a first tension applying part which applies tension to the first region of the cleaning sheet and a second tension applying part which applies tension to the second region of the cleaning sheet.

(Aspect 3)

The cleaning tool as defined in aspect 1 or 2, wherein the second tension applying part is disposed inward of the first tension applying part in the transverse direction.

(Aspect 4)

The cleaning tool as defined in any one of aspects 1 to 3, wherein the tension part is formed from the second tension applying part to the first tension applying part.

(Aspect 5)

The cleaning tool as defined in any one of aspects 1 to 4, wherein the cleaning sheet is configured to have a high-rigidity region having high rigidity and a low-rigidity region having lower rigidity than the high-rigidity region.

(Aspect 6)

The cleaning tool as defined in aspect 5, wherein the high-rigidity region continuously extends in the transverse direction.

(Aspect 7)

The cleaning tool as defined in aspect 5 or 6, comprising a first bonded part for connecting the first region and the second region, wherein the first bonded part is contiguous to the high-rigidity region.

(Aspect 8)

The cleaning tool as defined in any one of aspects 5 to 7, wherein the high-rigidity region comprises a second bonded part formed by welding the sheet member.

(Aspect 9)

The cleaning tool as defined in aspect 8, wherein the cleaning sheet has a fiber assembly and the second bonded part connects part of the fiber assembly and the sheet member.

(Aspect 10)

The cleaning tool as defined in any one of aspects 1 to 9, wherein:

the cleaning tool has an inserting direction parallel to the longitudinal direction and a pulling-out direction opposite to the inserting direction, and a projection formed on a lateral side surface of the extending part, the projection includes an inserting side region on a front side in the inserting direction, a pulling-out side region on a front side in the pulling-out direction, and an intermediate region between the inserting side region and the pulling-out side region, the projection has an insertion starting point at which the inserting side region first gets into contact with the bonded part when the holder is inserted into the insertion part; an insertion end point at which the contact of the inserting side region with the bonded part terminates when the holder is inserted into the insertion part; a first virtual line connecting the insertion starting point and the insertion end point; a second virtual line parallel to the inserting direction and passing through the insertion starting point; a first angle made by the first virtual line and the second virtual line; a pulling-out starting point at which the pulling-out side region first gets into contact with the bonded part when the holder is pulled out of the insertion part; a pulling-out end point at which the contact of the pulling-out side region with the bonded part terminates when the holder is pulled out of the insertion part; a third virtual line connecting the pulling-out starting point and the pulling-out end point; a fourth virtual line parallel to the pulling-out direction and passing through the pulling-out starting point; and a second angle made by the third virtual line and the fourth virtual line, and the first angle is smaller than the second angle.

The invention claimed is:

1. A cleaning tool, comprising:

a cleaning sheet; and a holder having a holding part configured to hold the cleaning sheet, and a grip part connected to the holding part and configured to be held by a user, wherein the cleaning tool has a longitudinal direction in which the holder is inserted into the cleaning sheet and a transverse direction crossing the longitudinal direction, the cleaning sheet has a first region formed by a first sheet member, a second region formed by a second sheet member, and an insertion part having an insertion space continuously extending in the longitudinal direction, the holding part is elongated in the longitudinal direction and configured to be inserted into the insertion part between the first region and the second region, the holding part includes a first end portion adjacent the grip part and a second end portion at a free end of the holding part, and a pair of first and second tension applying parts extending between and integral with the first and second end portions, the first tension applying part is a first elastic member configured to apply tension to the first region of the cleaning sheet, the second tension applying part is a second elastic member configured to apply tension to the second region of the cleaning sheet, the second tension applying part is disposed inward of the first tension applying part in the transverse direction, the first and second elastic members are curved in opposite directions transverse to the transverse direction, and when the holding part of the holder is inserted into the insertion part of the cleaning sheet, the second tension applying part of the holding part applies the tension to the second region of the cleaning sheet to form a tension part in the second region, and the second sheet member extending in the transverse direction in the tension part is moved toward the first region.

2. The cleaning tool as defined in claim 1, wherein the tension part is formed from the second tension applying part to the first tension applying part.

3. The cleaning tool as defined in claim 1, wherein the cleaning sheet has a high-rigidity region having high rigidity and a low-rigidity region having lower rigidity than the high-rigidity region.

4. The cleaning tool as defined in claim 3, wherein the high-rigidity region continuously extends in the transverse direction.

5. The cleaning tool as defined in claim 3, wherein the first and second regions are connected to each other at a first bonded part, and the first bonded part is contiguous to the high-rigidity region.

6. The cleaning tool as defined in claim 5, wherein the high-rigidity region comprises a second bonded part where the first sheet member and the second sheet member are welded together.

7. The cleaning tool as defined in claim 6, wherein the cleaning sheet has a fiber assembly, and the second bonded part connects part of the fiber assembly to the second sheet member.

8. The cleaning tool as defined in claim 1, wherein:

the cleaning tool has an inserting direction parallel to the longitudinal direction and a pulling-out direction opposite to the inserting direction, and a projection formed on a lateral side surface of the holding part, the projection includes an inserting side region on a front side in the inserting direction, a pulling-out side region on a front side in the pulling-out direction, and an intermediate region between the inserting side region and the pulling-out side region, the projection has an insertion starting point at which the inserting side region first gets into contact with a bonded part of the cleaning sheet when the holder is inserted into the insertion part;

an insertion end point at which the contact of the inserting side region with the bonded part terminates when the holder is inserted into the insertion part;

a first virtual line connecting the insertion starting point and the insertion end point;

a second virtual line parallel to the inserting direction and passing through the insertion starting point;

a first angle made by the first virtual line and the second virtual line;

a pulling-out starting point at which the pulling-out side region first gets into contact with the bonded part when the holder is pulled out of the insertion part;

a pulling-out end point at which the contact of the pulling-out side region with the bonded part terminates when the holder is pulled out of the insertion part;

a third virtual line connecting the pulling-out starting point and the pulling-out end point;

a fourth virtual line parallel to the pulling-out direction and passing through the pulling-out starting point; and a second angle made by the third virtual line and the fourth virtual line, and the first angle is smaller than the second angle.

9. The cleaning tool as defined in claim 1, wherein both the first and second tension applying parts are configured to be inserted into the same insertion space of the cleaning sheet.

10. The cleaning tool as defined in claim 1, wherein the first and second sheet members are bonded at a center bonding line bisecting a width of the cleaning sheet in the transverse direction and extending in the longitudinal direction, and when the holding part of the holder is inserted into the insertion part of the cleaning sheet, the second tension applying part is disposed between the first tension applying part and the center bonding line in the transverse direction.

11. The cleaning tool as defined in claim 1, wherein when the holding part of the holder is inserted into the insertion space of the cleaning sheet, the first and second tension applying parts expand the holding space in a thickness direction perpendicular to the longitudinal direction and the transverse direction by restoring forces of the first and second tension applying parts.

12. The cleaning tool as defined in claim 1, wherein the holder includes a further holding part connected to the holding part at the first end portion, the further holding part includes a pair of further first and second tension applying parts having further first and second elastic members, respectively, the cleaning sheet includes a further insertion space continuously extending in the longitudinal direction, and configured to receive the further first and second elastic members of the further holding part, and the insertion space is configured to receive the first and second elastic members of the holding part.

13. A cleaning tool, having a cleaning sheet and a holder for holding the cleaning sheet, wherein:

the cleaning tool has a longitudinal direction in which the holder is inserted into the cleaning sheet and a transverse direction crossing the longitudinal direction, the cleaning sheet has a first region formed by a sheet member, a second region formed by a sheet member, and an insertion part which has an insertion space continuously extending in the longitudinal direction in order to allow the holder to be inserted between the first region and the second region, the holder has a holding part which is inserted into the insertion space of the cleaning sheet and holds the cleaning sheet, a tension applying part which is provided in the holding part and applies prescribed tension to the second region of the cleaning sheet, and a grip part which is connected to the holding part and designed to be held by a user, and when the holding part of the holder is inserted into the insertion part of the cleaning sheet, the tension applying part of the holding part applies tension to the second region of the cleaning sheet so that the second region forms a tension part, and the sheet member extending in the transverse direction in the tension part is moved in a direction toward the first region, the cleaning tool has an inserting direction parallel to the longitudinal direction and a pulling-out direction opposite to the inserting direction, and a projection formed on a lateral side surface of the holding part, the projection includes an inserting side region on a front side in the inserting direction, a pulling-out side region on a front side in the pulling-out direction, and an intermediate region between the inserting side region and the pulling-out side region, the projection has an insertion starting point at which the inserting side region first gets into contact with a bonded part of the cleaning sheet when the holder is inserted into the insertion part;

an insertion end point at which the contact of the inserting side region with the bonded part terminates when the holder is inserted into the insertion part;

a first virtual line connecting the insertion starting point and the insertion end point;

a second virtual line parallel to the inserting direction and passing through the insertion starting point;

a first angle made by the first virtual line and the second virtual line;

a pulling-out starting point at which the pulling-out side region first gets into contact with the bonded part when the holder is pulled out of the insertion part;

a pulling-out end point at which the contact of the pulling-out side region with the bonded part terminates when the holder is pulled out of the insertion part;

a third virtual line connecting the pulling-out starting point and the pulling-out end point;

a fourth virtual line parallel to the pulling-out direction and passing through the pulling-out starting point; and a second angle made by the third virtual line and the fourth virtual line, and the first angle is smaller than the second angle.

14. A cleaning tool, comprising:

a cleaning sheet; and a holder having a holding part configured to hold the cleaning sheet, and a grip part connected to the holding part and configured to be held by a user, wherein the cleaning tool has a longitudinal direction in which the holder is inserted into the cleaning sheet and a transverse direction crossing the longitudinal direction, the cleaning sheet has a first region formed by a first sheet member, a second region formed by a second sheet member, and an insertion part having an insertion space continuously extending in the longitudinal direction, the holding part is configured to be inserted in the insertion part between the first region and the second region, the holding part includes a first tension applying part configured to apply tension to the first region of the cleaning sheet, and a second tension applying part configured to apply tension to the second region of the cleaning sheet, the second tension applying part is disposed inward of the first tension applying part in the transverse direction, and when the holding part of the holder is inserted into the insertion part of the cleaning sheet, the second tension applying part of the holding part applies the tension to the second region of the cleaning sheet to form a tension part in the second region, the second sheet member extending in the transverse direction in the tension part is moved toward the first region, the cleaning tool has an inserting direction parallel to the longitudinal direction and a pulling-out direction opposite to the inserting direction, and a projection formed on a lateral side surface of the holding part, the projection includes an inserting side region on a front side in the inserting direction, a pulling-out side region on a front side in the pulling-out direction, and an intermediate region between the inserting side region and the pulling-out side region, the projection has an insertion starting point at which the inserting side region first gets into contact with a bonded part of the cleaning sheet when the holder is inserted into the insertion part;

an insertion end point at which the contact of the inserting side region with the bonded part terminates when the holder is inserted into the insertion part;

a first virtual line connecting the insertion starting point and the insertion end point;

a second virtual line parallel to the inserting direction and passing through the insertion starting point;

a first angle made by the first virtual line and the second virtual line;

a pulling-out starting point at which the pulling-out side region first gets into contact with the bonded part when the holder is pulled out of the insertion part;

a pulling-out end point at which the contact of the pulling-out side region with the bonded part terminates when the holder is pulled out of the insertion part;

a third virtual line connecting the pulling-out starting point and the pulling-out end point;

a fourth virtual line parallel to the pulling-out direction and passing through the pulling-out starting point; and a second angle made by the third virtual line and the fourth virtual line, and the first angle is smaller than the second angle.

* * * * *